US006642950B2

(12) United States Patent
Otose et al.

(10) Patent No.: US 6,642,950 B2
(45) Date of Patent: Nov. 4, 2003

(54) OPTICAL PRINTER HEAD AND DRIVING METHOD THEREOF

(75) Inventors: Tomohiko Otose, Tokyo (JP); Hideki Asada, Tokyo (JP)

(73) Assignee: NEC Corporation, Tokyo (JP)

( * ) Notice: Subject to any disclaimer, the term of this patent is extended or adjusted under 35 U.S.C. 154(b) by 47 days.

(21) Appl. No.: 09/835,519

(22) Filed: Apr. 17, 2001

(65) Prior Publication Data

US 2001/0033323 A1 Oct. 25, 2001

(30) Foreign Application Priority Data

Apr. 19, 2000 (JP) ..... 2000-117368

(51) Int. Cl.[7] ..... B41J 2/435
(52) U.S. Cl. ..... 347/237; 347/247
(58) Field of Search ..... 347/237, 238, 347/247, 256, 130, 128, 240

(56) References Cited

U.S. PATENT DOCUMENTS 5,892,532 A * 4/1999 Katakura et al. ..... 347/240

FOREIGN PATENT DOCUMENTS

| | | |
|---|---|---|
| JP | 58-65682 | 4/1983 |
| JP | 8-108568 | 4/1996 |
| JP | 9-254437 | 9/1997 |
| WO | WO98/40871 | 9/1998 |

* cited by examiner

*Primary Examiner*—Hai Pham
(74) *Attorney, Agent, or Firm*—McGinn & Gibb, PLLC

(57) ABSTRACT

An optical printer head usable in an optical printer with a line light source and suitably utilizing an organic electroluminscence (EL) element and the like as its light-emitting element that includes a pixel array including pixels arranged two-dimensionally in row and column directions, each of the pixels including a light-emitting element, a memory array including memory cells arranged two-dimensionally in row and column directions for holding printing data input thereto, a horizontal scanning circuit for supplying a data signal to each memory cell column, a first vertical scanning circuit for sequentially selecting memory cell rows to write data to each memory cell, a circuit for arbitrarily selecting the memory cell rows to read data from each memory cell, a second vertical scanning circuit for sequentially selecting pixel rows, and a buffer located between the memory array and the pixel array.

22 Claims, 22 Drawing Sheets

OPTICAL PRINTER HEAD AND DRIVING METHOD THEREOF

BACKGROUND OF THE INVENTION

1. Field of the Invention

The present invention relates to an optical printer head and a driving method thereof, and more particularly to an optical printer head and a driving method thereof for use in exposure of a photosensitive member to light in an electrophotographic printer.

2. Description of the Prior Art

Conventionally, an optical printer using a line light source and a laser printer are known as electrophotographic printers. The laser printer modulates laser light in accordance with output data to produce modulated laser light which scans on a photosensitive drum using a plurality of lens systems and a polygon mirror to form an image with the light on the photosensitive drum before development of the image, thereby producing printed output.

The laser printer allows a faster speed, a higher quality image, and a lower noise level than a dot impact printer and an ink-jet printer. The laser printer is not only used for business as a printer capable of printing on plain paper, but also becoming prevalent for home use in recent years.

The optical printer with a line light source employs a line light source including light-emitting elements placed in a line, and has an advantage of no need of a scanning optical system since the aligned light-emitting elements irradiate associated spots on a photosensitive member with light, respectively. Thus, the optical printer with the line light source can realize higher reliability and a smaller size of a printer apparatus.

FIG. 1 shows a general configuration of a conventional optical printer using a line light source. In FIG. 1, the conventional optical printer generally comprises data input section 51 for receiving printing data, photosensitive drum 27, optical printer head 21 for exposing photosensitive drum 27 to light in accordance with image data, converging rod lens array 24 for forming an image with the light from optical printer head 21 on photosensitive drum 27, charger 42, cleaner 25, developer 43, transferrer 44, and charge eliminator 45. Charger 42, cleaning section 25, developer 43, transferrer 44, and charge eliminator 45 are placed to surround photosensitive drum 27.

The operation of the conventional optical printer using the line light source is hereinafter described with reference to FIG. 1.

Image data output from data input section 51 is input to a driving circuit of optical printer head 21. The output from the driving circuit causes the line light source in optical printer head 21 to emit light. The light emitted from the activated optical printer head 21 is converged by converging rod lens array 24 and irradiated to photosensitive drum 27. The surface of photosensitive drum 27 has been uniformly charged by charger 42 such that electric charge is removed in the portions irradiated with the light from optical printer head 21 to write an electrostatic latent image on photosensitive drum 27.

Developer 43 sprays charged particles (toner) onto the surface of photosensitive drum 27 with the electrostatic latent image written thereon to develop the electrostatic latent image, thereby forming a toner image. The toner image reaches object 26 of printing such as a sheet of paper with the rotation of photosensitive drum 27, and is transferred onto object 26 of printing through the application of an electric field by transferrer 44. The transferred toner image is fixed on object 26 of printing by a fixer (not shown).

The residual electric charge on the surface of photosensitive drum 27 after it passes through transferrer 44 is removed by charge eliminator 45, and finally, cleaner 25 removes the toner remaining on the surface of photosensitive drum 27 after the transfer.

As a light source of such an optical printer, for example, Japanese Patent Laid-open Publication No. Sho 58-65682 (JP, 58065682, A) discloses the use of a light source including a number of LEDs (Light Emitting Diodes) placed in a line.

A ceramic substrate formed of alumina is primarily used as a substrate of a printer head using LEDs. The printer head is formed by placing a plurality of LED chips in a line on the ceramic substrate, performing die bonding of IC (Integrated Circuit) chips serving as driving circuits on both sides of the LED chips with conductive paste, and then making electrical connection through wire bonding. The ceramic substrate of the printer head is supplied with electric signals and power from the main body of the printer through an FPC (Flexible Printing Cable).

For the LED chips in this case, an array of LEDS for 64 dots or 128 dots and with approximately 60 $\mu$m pitches is currently used in consideration of limitations on the size of an n-type GaAsP substrate for forming part of the LED chips, yields in the manufacturing process, and the like. A plurality of such LED chips need be arranged to form a line light source of a printer head, and in such a case, highly accurate cutting technique and mounting technique on the order of micrometers are required to increase the accuracy of the arrangement.

In addition, since the n-type GaAsP substrate used is small, expensive, and even causes many defects, an attempt to increase the number of dots for light emission in a monolithic LED chip leads to reduced yields and significantly increased manufacturing cost. A method of avoiding these problems is to mass-produce LED chips for a reduced number of dots which are aligned over the length covering the printing width corresponding to an object of printing. This method, however, has mounting limitations from the issues in the arrangement of the chips and the electrical connection when a higher density is intended. As a result, the optical printer with the LEDs has limitations in providing a lower cost and higher density.

To address such problems, the use of a light-emitting element other than the LED is considered. For example, Japanese Patent Laid-open Publication No. Hei 8-108568 (JP, 08108568, A) discloses an optical printer head using an organic EL (electroluminescence) thin film light-emitting element. Since the optical printer head using the organic EL light-emitting element enables the formation of a number of light-emitting elements together on a substrate of large area as well as mass production, a lower cost can be expected. In addition, a higher density is possible due to micromachining of electrode sections in the manufacturing process.

Light-emitting elements are arranged two-dimensionally in an optical printer head to allow exposure to light in a short time even if they emit light at low luminance. For example, Japanese Patent Laid-Open Publication No. Hei 9-254437 (JP, 09254437, A) describes a printer having a printing head in which light-emitting elements are arranged two-dimensionally and a pixel array using a group of optical fibers as its front panel is used.

However, for the optical printer head using a thin film light-emitting element such as an organic EL element, the performance of the current organic EL element has a limitation of emitting light up to a luminance of several hundreds of cd/m$^2$ assuming that its useful life is several tens of thousands hours. In other words, when the current organic EL element is used, it is difficult to meet both needs for the amount of light required for exposure as a printer head and for the practical life. The practical life refers to the maximum number of sheets of paper required for use as a printer.

It is contemplated that a replaceable optical printer head is employed to allow light emission at a higher luminance at the expense of the useful life. However, it is difficult for a user to align a new optical printer head with a photosensitive drum and optical systems on the order of micrometers in replacing an old optical printer head.

Problems common to electrophotographic printers include the need of correction for sensitivity characteristics of a photosensitive member, the need of correction for misalignment of an object of printing, the need of correction for insufficient development in an area exposed to a small amount of light when multi-level gradation printing is performed, and the like.

Of these corrections, as to the correction for sensitivity characteristics of a photosensitive member, the characteristics of potentials on the surface of the photosensitive member with respect to an amount of light exposure is not necessarily linear, and as a result, the operation of the printer need be performed in accordance with the sensitivity characteristics of the photosensitive member. The correction of misalignment of an object of printing must be performed without exception since the misalignment causes reduced printing quality. The problem of insufficient development in an area exposed to a small amount of light generally occurs in a conventional photosensitive member, and requires certain countermeasures similarly to the other two problems.

When light-emitting elements are arranged two-dimensionally, an increased number of light-emitting elements causes increases in driving circuits, wiring and the like provided outside the optical printer head, thereby making it difficult to achieve a higher density and a smaller size. The two-dimensionally arranged light-emitting elements are referred to as a pixel array. A method of driving a printer using the pixel array requires rewriting of data in all the pixels of the pixel array during a main scanning period. This results in the need of serial input of printing data to all pixel columns during the main scanning period. Thus, the realization of a printer capable of fast printing involves a high driving frequency required for its driving circuits.

SUMMARY OF THE INVENTION

It is an object of the present invention to provide an optical printer head which can be driven with a driver IC with a low driving frequency and which can easily realize a higher density, a smaller size, and faster printing.

It is another object of the present invention to provide a method of driving an optical printer head which can be driven with a driver IC with a low driving frequency and which can easily realize a higher density, a smaller size, and faster printing.

The first object of the present invention is achieved by an optical printer head comprising: a pixel array including pixels arranged two-dimensionally in a row direction and a column direction, each of the pixels including a light-emitting element; a memory array including memory cells arranged two-dimensionally in a row direction and a column direction for holding printing data input thereto; a horizontal scanning circuit for supplying a data signal to each memory cell column in the memory array; a first vertical scanning circuit for sequentially selecting memory cell rows to write binary data to each memory cell in the memory array; a selecting circuit for arbitrarily selecting the memory cell rows to read binary data from each memory cell in the memory array; a second vertical scanning circuit for sequentially selecting pixel rows in the pixel array; and a buffer located on a transfer path between the memory array and the pixel array.

The optical printer head of the present invention may further comprise a switch array located on a transfer path between the horizontal scanning circuit and the memory array. Alternatively, the optical printer head may comprise a first switch array located on a transfer path between the horizontal scanning circuit and the memory array and a second switch array located on a transfer path between the memory array and the pixel array.

In the present invention, the respective circuits are preferably formed on a single insulator substrate, and each of them is preferably formed of a polycrystalline silicon thin film transistor.

In the present invention, an organic electroluminescence element may be used as the light-emitting element, for example.

According to the optical printer head of the present invention, a higher density, a smaller size, and faster printing are possible. Also, since a plurality of the light-emitting elements in the vertical scanning direction can expose the same spot on the photosensitive member to light a plurality of times, it is possible to achieve exposure to a desired amount of light even when the light-emitting elements emit a small amount of light. Therefore, according to the present invention, the optical printer head can be driven even with a driver IC driven at a low frequency in reading from the memory array.

In another aspect of the present invention, the horizontal scanning circuit may comprise a shift register, a data register, a latch, and a buffer. With such a configuration, only a start signal including a single pulse is transmitted within the shift register, which reduces the influence of a resistance load and a capacitive load impairing the transmission. Thus, the present invention can provide the optical printer head capable of faster input and transfer of printing data.

In another aspect of the present invention, the pixel array in the optical printer head may be divided into a plurality of groups of sub-pixels each comprising a plurality of sub-pixels in the same row direction and the same column direction, and the vertical scanning circuit for the pixel array may be configured to vary the number of sub-pixels emitting light among groups of sub-pixels. Such a configuration enables multi-level gradation printing with binary data as input.

The optical printer head of the present invention may comprise a first switch array and a second switch array at the input and output of the memory array, respectively. Such a configuration allows operations similar to those in the aforementioned configurations even when the memory cell includes one data line serving both as a writing data line and a reading data line.

In a yet another aspect of the present invention, the optical printer head comprises the data input buffer and the first switch array on a transfer path between the horizontal scanning circuit and the memory array, and the sense amplifier and the second switch array on a transfer path between the memory array and the pixel array. It is thus possible to perform operations similar to those in the aforementioned configurations with a static RAM (Random Access Memory) used for the memory cell.

The second object of the present invention is achieved by a method of selectively irradiating a surface of a rotatable photosensitive member with light in accordance with printing data using the aforementioned optical printer head of the present invention, comprising the steps of: in a state where pixel rows in the pixel array are in parallel to a rotational axis of the photosensitive member and the light-emitting element emits light in a direction opposed to the surface of the photosensitive member, establishing a state where a spot on the surface of the photosensitive member is irradiated with light or a state where the spot is not irradiated with light by means of one of light emission and no emission from an n-th pixel (where n is an integer equal to or greater than 1) in the pixel array; and establishing a state where the spot on the surface of the photosensitive member is irradiated with light or a state where the spot is not irradiated with light by means of one of light emission and no emission from an (n+1)-th pixel in the pixel array during a period in which the spot passes the (n+1)-th pixel.

In the driving method of the present invention, the photosensitive member is typically a photosensitive drum. A time period for the photosensitive drum to move over one pixel row in the pixel array is considered as a main scanning period, and it is preferable that (a) during the main scanning period, printing data input from the outside is input to the horizontal scanning circuit and the printing data is held in the latch circuit in the horizontal scanning circuit in response to a latch signal input from the outside, and (b) during the input of the printing data from the outside to the horizontal scanning circuit, printing data is read from the memory array and written to the pixel array to perform one of light emission and no emission sequentially in the light-emitting elements in the pixel array, and printing data for one row held in the horizontal scanning circuit is written to the memory cell.

In the driving method of the present invention, since data writing to the memory array from the horizontal scanning circuit and subsequent writing to the pixel array from the memory array are performed during the same horizontal scanning period, data for one row in the pixel array input in a horizontal scanning period can be written to the pixel array in the next horizontal scanning period.

As described above, according to the present invention, it is possible, in the optical printer head including a plurality of the light-emitting elements arranged two-dimensionally, to achieve exposure to a desired amount of light even when the light-emitting elements emit light at a low luminescence. In addition, according to the present invention, correction for sensitivity characteristics of the photosensitive member and correction for misalignment of an object of printing can be performed easily, and multi-level gradation printing can be performed with binary data. The memory array including a number of memory cells formed thereon for allowing writing, holding, and reading of data is provided on the same substrate, and printing data for all the pixels are held in and read from the memory array. Thus, according to the present invention, the optical printer head can be driven even with a driver IC driven at a low frequency, and it is possible to provide the optical printer head facilitating a higher density, a smaller size, and faster printing.

The above and other objects, features, and advantages of the present invention will become apparent from the following description referring to the accompanying drawings which illustrate examples of preferred embodiments of the present invention.

DESCRIPTION OF THE PREFERRED EMBODIMENTS

Figure 1:
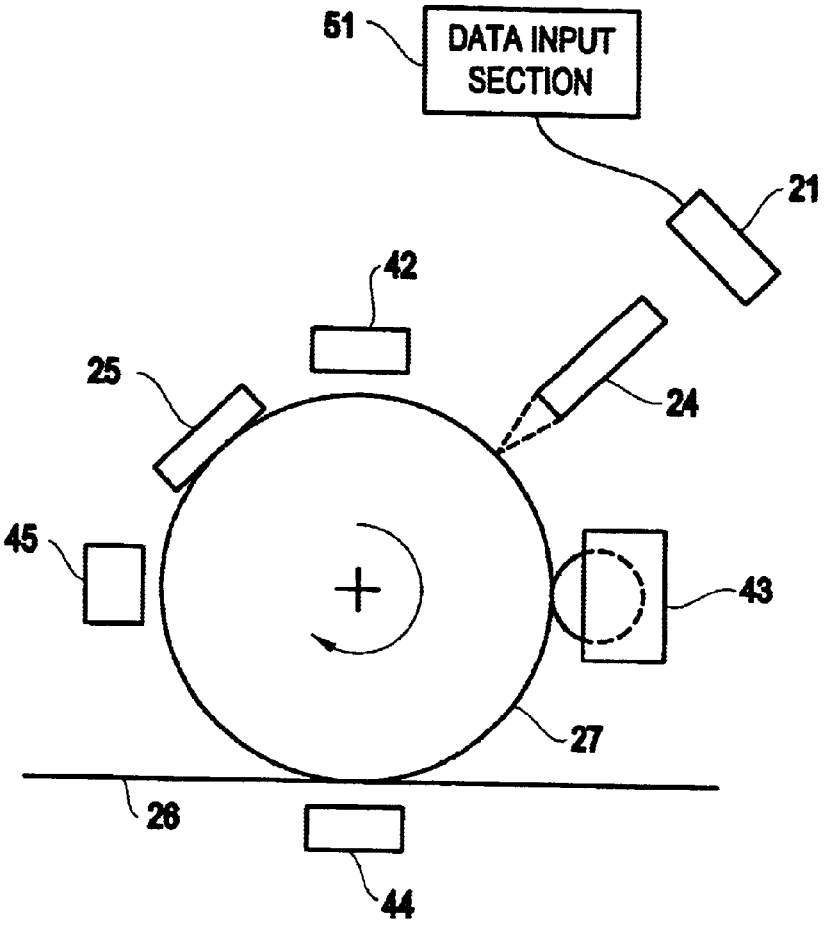
FIG.1 PRIOR ART
FIG. 1 shows a general configuration of a conventional optical printer using a line light source.
Figure 2:
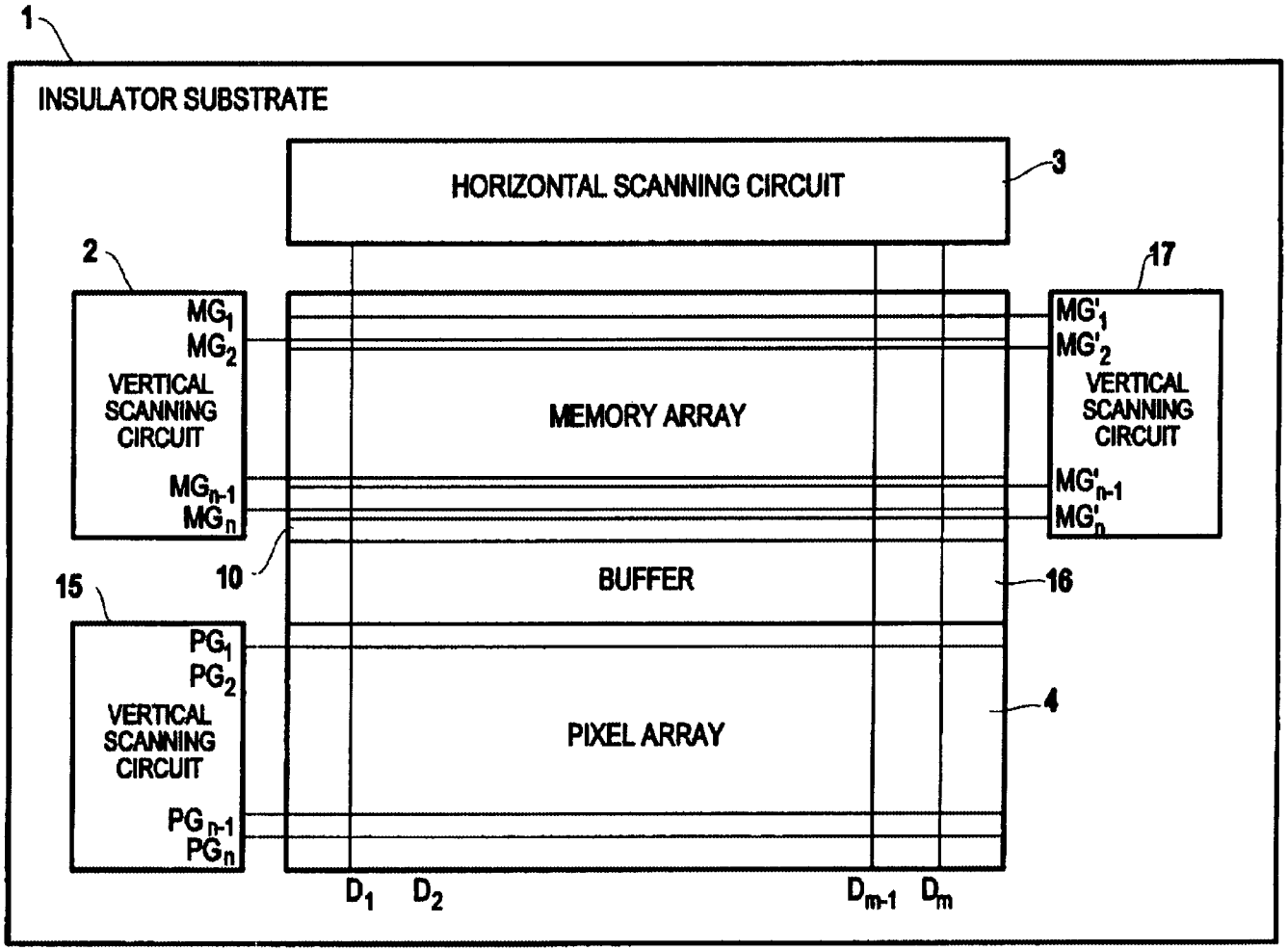
FIG. 2 is a block diagram showing a configuration of an optical printer head according to a first embodiment of the present invention.

Referring to FIG. 2, there is shown an optical printer head according to a first embodiment of the present invention, generally comprising insulator substrate 1, vertical scanning circuit 2 for memory reading, memory array 10, pixel array 4, vertical scanning circuit 15 for the pixel array, vertical scanning circuit 17 for memory writing, horizontal scanning circuit 3, and buffer 16. Vertical scanning circuits 2, 15, 17, memory array 10, pixel array 4, horizontal scanning circuit 3, and buffer 16 are placed on the same insulator substrate 1.

Memory array 10 includes a plurality of memory cells arranged two-dimensionally for holding printing data input thereto from the outside such that they are arranged vertically in arbitrary m columns (m is an integer equal to or larger than 2) and horizontally in arbitrary n rows (n is an integer equal to or larger than 2). In the following description, memory cell rows (MG1, MG2, . . . , MGn−1, MGn) in the vertical direction in memory cell array 10 are referred to as vertical memory cell sequences, while memory cell columns (D1, D2, . . . , Dm−1, Dm) in the horizontal direction are referred to as horizontal memory cell sequences. Pixel array 4 has a plurality of pixels each including a light-emitting element and arranged two-dimensionally in m rows in the vertical direction and in n columns in the horizontal direction. Similarly to the memory array, pixel rows (PG1, PG2, . . . , PGn−1, PGn) in the vertical direction in pixel array 4 are referred to as vertical pixel sequences of pixel array 4, while pixel columns (PD1, PD2, . . . , PDm−1, PDm) in the horizontal direction are referred to as horizontal pixel sequences of pixel array 4. The memory cells in memory array 10 correspond to the pixels in pixel array 4 in a one-to-one relationship.

Vertical scanning circuit 2 for memory reading arbitrarily selects a memory cell row to read binary data from each memory cell in memory array 10. Horizontal scanning circuit 3 horizontally scans memory array 10 and pixel array 4 in accordance with input data. Horizontal scanning circuit 3 supplies a data signal to each memory cell sequence in memory array 10.

Vertical scanning circuit 15 for the pixel array sequentially selects each pixel row in pixel array 4. Vertical scanning circuit 17 for memory writing sequentially scans memory cell rows to write binary data to each memory cell in memory array 10. Buffer 16 is placed on a transfer path between memory array 10 and pixel array 4. Buffer 16 amplifies data in memory cells belonging to a selected memory cell row in memory array 10 when the data are transferred in parallel to pixels belonging to a selected pixel row in pixel array 4.

Figure 3:
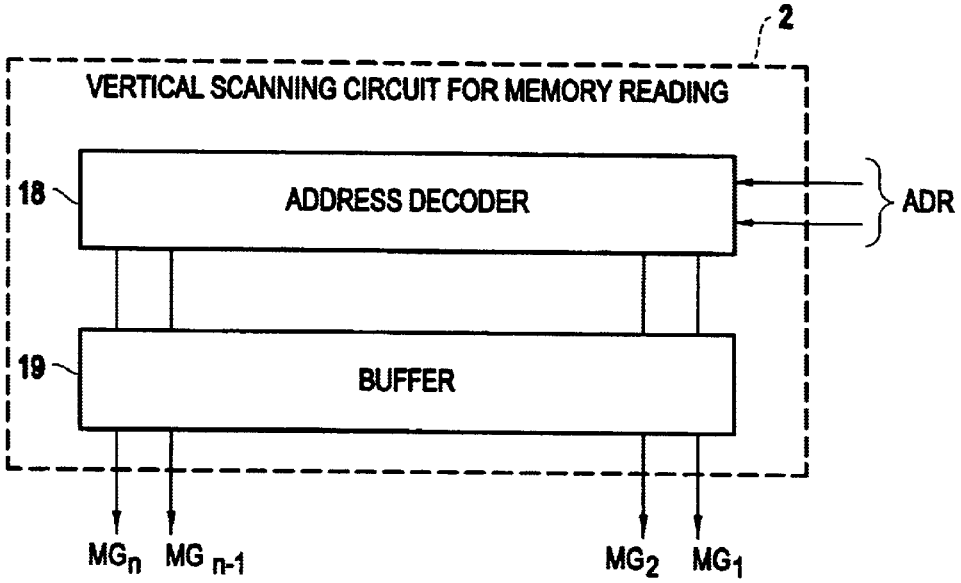
FIG. 3 is a block diagram showing a configuration of a vertical scanning circuit for memory reading.

As shown in FIG. 3, vertical scanning circuit 2 for memory reading comprises address decoder 18 and buffer 19. Address decoder 18 has a plurality of binary elements arranged in the vertical direction equal to the number of vertical pixel sequences in memory array 10, and operates on pulses supplied as address data ADR. Buffer 19 has a plurality of amplifying elements arranged in the vertical direction corresponding to the vertical pixel sequences in memory array 10 similarly to address decoder 18. Buffer 19 amplifies the outputs from the respective binary elements in address decoder 18 to produce outputs corresponding to vertical memory cell sequences MG1, MG2, . . . , MGn−1, and MGn.

Figure 4:
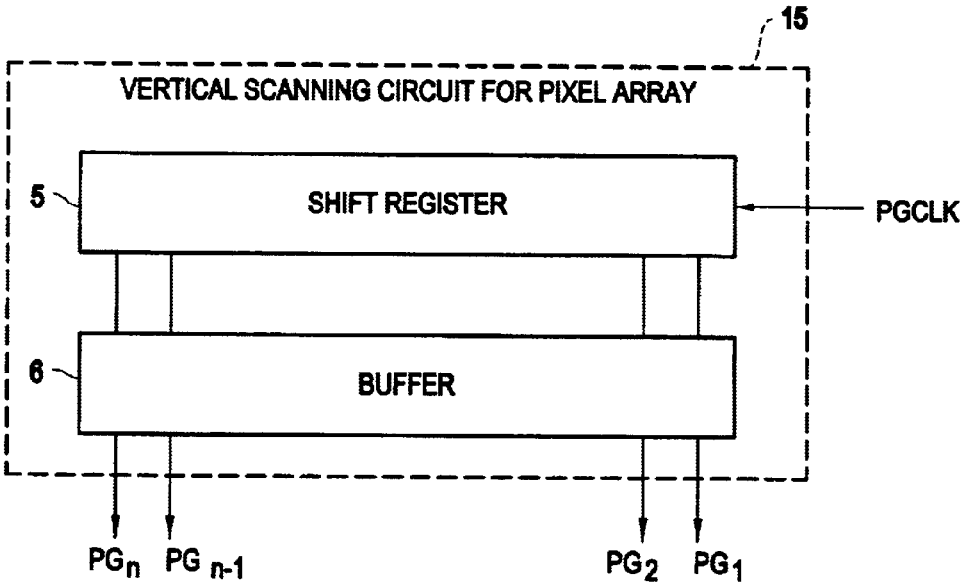
FIG. 4 is a block diagram showing a configuration of a vertical scanning circuit for a pixel array.

As shown in FIG. 4, vertical scanning circuit 15 for the pixel array comprises shift register 5 and buffer 6. Shift register 5 has a plurality of binary elements arranged in the vertical direction corresponding to the vertical pixel sequences in pixel array 4, and sequentially transfers pulses of vertical clock PGCLK input thereto in the vertical direction. Buffer 6 has a plurality of amplifying elements arranged in the vertical direction corresponding to the vertical pixel sequences in pixel array 4, and amplifies the outputs from the respective binary elements in shift register 5 to produce outputs corresponding to vertical pixel sequences PG1, PG2, . . . , PGn−1, and PGn in pixel array 4.

Figure 5:
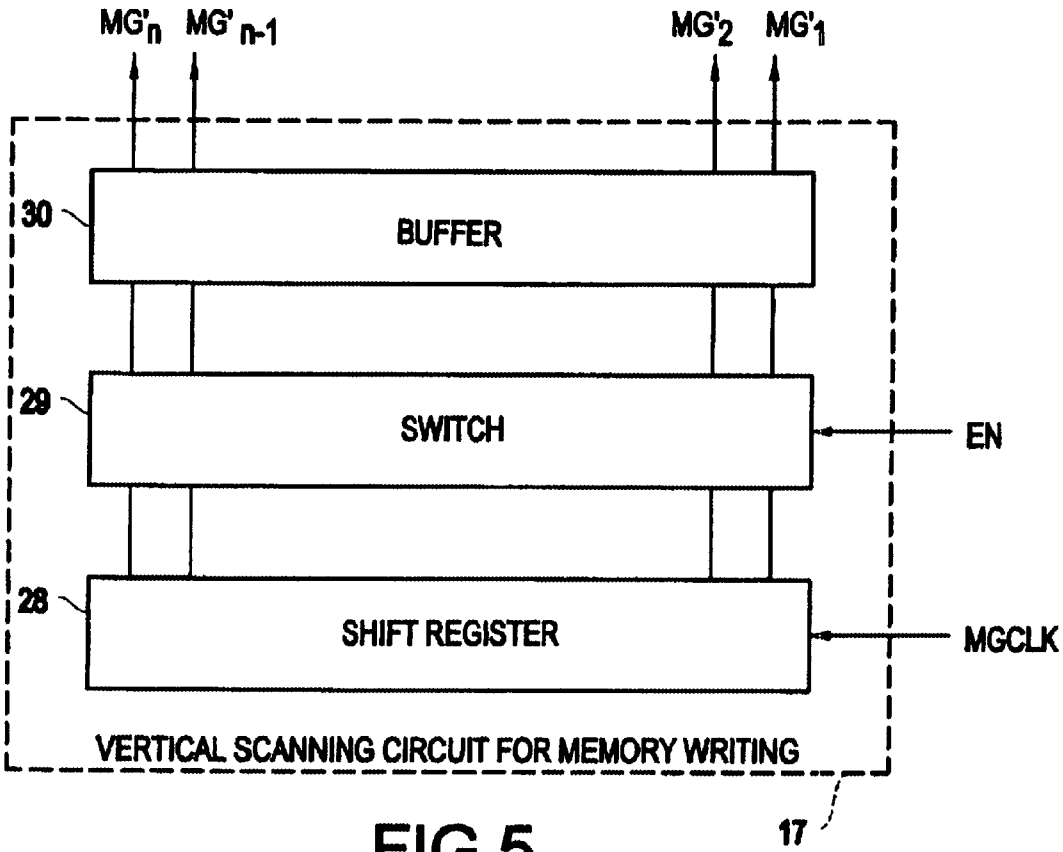
FIG. 5 is a block diagram showing a configuration of a vertical scanning circuit for memory writing.

As shown in FIG. 5, vertical scanning circuit 17 for memory writing comprises shift register 28, switch 29, and buffer 30. Shift register 28 has a plurality of binary elements arranged in the vertical direction corresponding to the vertical memory cell sequences, and sequentially transfers pulses of vertical clock MGCLK input thereto in the vertical direction. Switch 29 selects a high level or a low level at an arbitrary time, has a plurality of binary elements arranged in the vertical direction corresponding to the vertical memory cell sequences, and is controlled by enable pulse EN. A NAND gate or a NOR gate is typically used as switch 29, but any configuration is permissible as long as it employs a pulse-controlled switch. Buffer 30 has a plurality of amplifying elements arranged in the vertical direction corresponding to the vertical memory cell sequences, and amplifies the outputs from the respective binary elements in switch 29 to produce outputs corresponding to vertical memory cell sequences MG1', MG2', . . . , MGn−140 , and MGn'.

Figure 6:
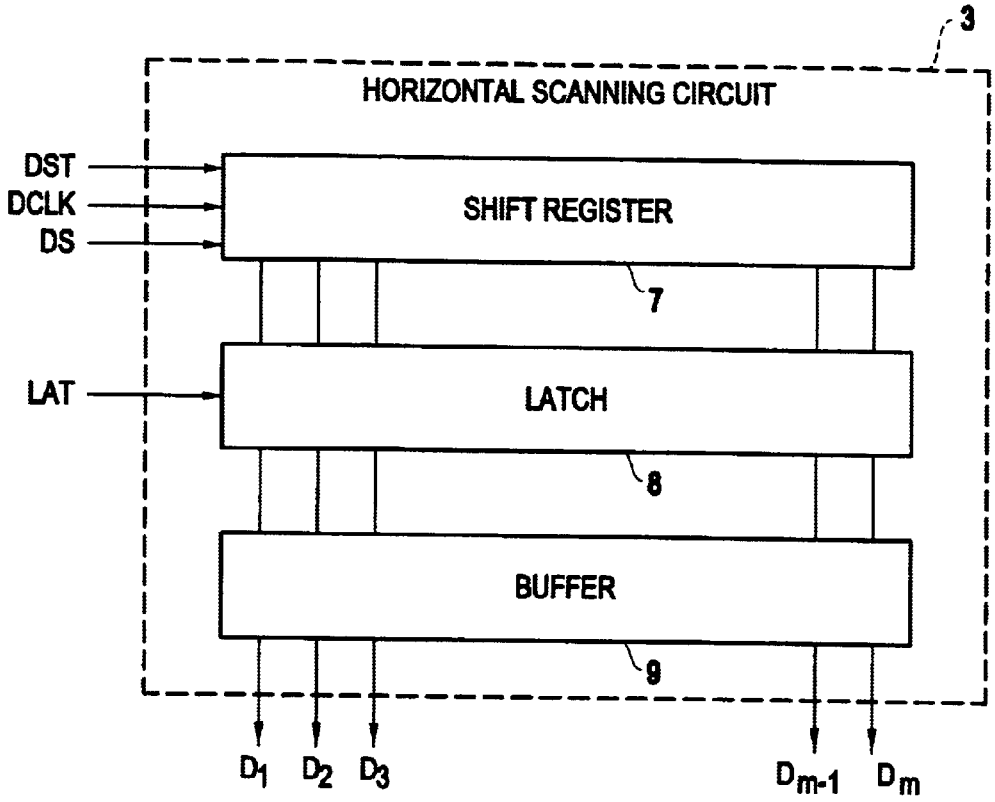
FIG. 6 is a block diagram showing a configuration of a horizontal scanning circuit.

As shown in FIG. 6, horizontal scanning circuit 3 comprises shift register 7, latch 8, and buffer 9. Shift register 7 has a plurality of binary elements arranged in the horizontal direction corresponding to the horizontal pixel sequences, and sequentially shifts in the horizontal direction printing data DS comprising a serial signal of m bits input thereto from a data input section (not shown) in accordance with horizontal clock DCLK. Latch 8 has a plurality of holding elements arranged in the horizontal direction corresponding to the horizontal pixel sequences, and latches the output data from the respective binary elements in shift register 7 to output the data in accordance with latch signal LAT. Buffer 9 has a plurality of amplifying elements arranged in the horizontal direction corresponding to the horizontal pixel sequences. Buffer 9 amplifies the data held by the respective holding elements in latch 8 to produce outputs corresponding to horizontal pixel sequences D1, D2, . . . , Dm−1, and Dm.

Figure 7:
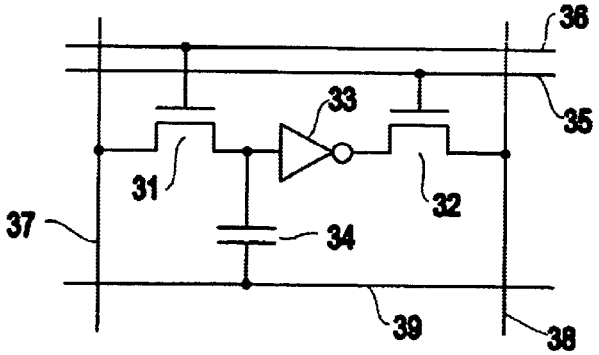
FIG. 7 is a circuit diagram showing an example of a configuration of a memory cell in a memory array.

As described above, memory array 10 comprises memory cells arranged two-dimensionally. FIG. 7 shows an example of a configuration of each memory cell for use in the optical printer head. The memory cell shown comprises writing transistor 31, reading transistor 32, inverter 33, capacitor 34 for holding data, writing scanning line 35, reading scanning line 36, writing data line 37, reading data line 38, and capacitance line 39. In the figures, writing data line 37 and reading data line 38 for each vertical memory cell sequence can be represented as MG1, MG2, . . . , MGn−1or MGn and MG1', MG2', . . . , MGn−1' or MGn'.

Figure 8:
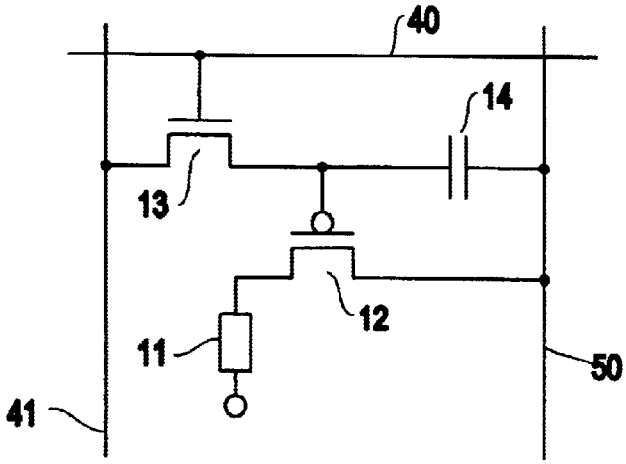
FIG. 8 is a circuit diagram showing a configuration of a pixel in a pixel array.

On the other hand, FIG. 8 shows a configuration of a pixel in this embodiment. Each pixel comprises light-emitting element 11, switching transistor (driving transistor) 12 for driving light-emitting element 11, switching transistor (selecting transistor) 13 for selecting light-emitting element 11, capacitor 14, and power line 50. In the example shown, an N-channel transistor and a P-channel transistor are used as selecting transistor 13 and driving transistor 12, respectively.

Light-emitting element 11 emits light when connected to power line 50 through driving transistor 12. Driving transistor 12 has drain D connected to an electrode section of light-emitting element 11, source S connected to power line 50, and gate G connected to source S of selecting transistor 13. Selecting transistor 13 has gate G connected to pixel scanning line 40, drain D connected to pixel data line 41, and source S connected to power line 50 through capacitor 14. Pixel scanning line 40 is connected to the output from vertical scanning circuit 2 for memory reading corresponding to this pixel. Pixel data line 41 is connected to the output from horizontal scanning circuit 3 corresponding to this pixel.

As long as the aforementioned connections are established in each pixel area, any placement of light-emitting element 11, driving transistor 12, and selecting transistor 13 may be made on insulator substrate 1. Light may be obtained from light-emitting element 11 in a direction in which light passes through insulator substrate 1 or a direction in which light does not pass through insulator substrate 1 as long as the direction is perpendicular to or substantially perpendicular to the surface of insulator substrate 1.

In this embodiment, each of horizontal scanning circuit 3 and vertical scanning circuits 2, 15, 17 may be formed of single crystalline silicon or polycrystalline silicon. The use of the polycrystalline silicon provides an advantage that these circuits can be formed simultaneously with pixel array 4 on the insulator substrate made of, for example, a glass substrate.

Driving transistor 12 and selecting transistor 13 of each pixel in pixel array 4, and writing transistor 31, reading transistor 32, and inverter 33 of each memory cell in memory array 10 may be formed of any of single crystalline silicon, amorphous silicon, and polycrystalline silicon (polysilicon) in principle. While a p-channel transistor and an n-channel transistor are contemplated as the type of the transistors, either of them may be used.

Light-emitting element 11 may be any element which emits light by itself, and the use of an organic EL element is particularly preferable. The organic EL element basically has a structure including a pixel electrode/a light-emitting layer/an opposite electrode in which the light-emitting layer is sandwiched between the pixel electrode and the opposite electrode, but the structure is not necessarily limited thereto. The structure may include a pixel electrode/a light-emitting layer/an electron injection layer/an opposite electrode, a pixel electrode/a hole injection layer/a light-emitting layer/an opposite electrode, or a pixel electrode/a hole injection layer/a light-emitting layer/an electron injection layer/an opposite electrode. In each of the cases, the light-emitting layer is formed of at least one kind of organic light-emitting material.

Figure 9:
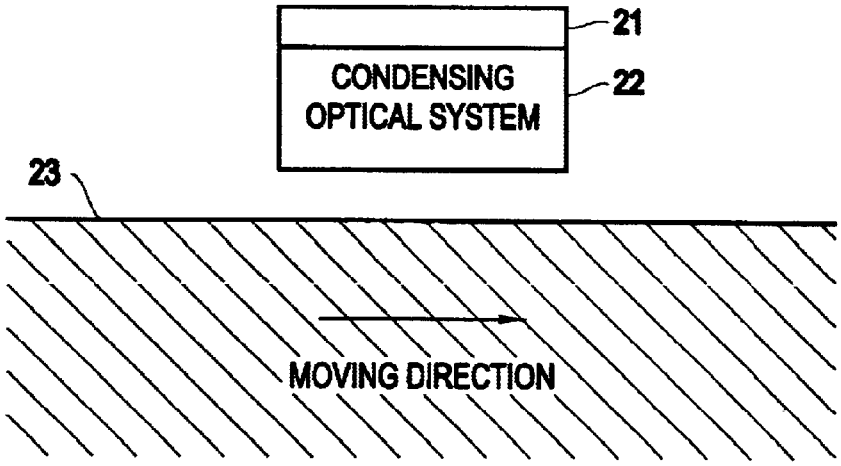
FIG. 9 is a schematic diagram showing a configuration of a light-emitting surface of an optical printer using the optical printer head shown in FIG. 2.

FIG. 9 shows a configuration of a light-emitting surface of an optical printer using the aforementioned optical printer head. The light-emitting surface of optical printer head 21 is in contact with one end face of condensing optical system 22. The other end face of condensing optical system 22 is disposed opposite to photosensitive member 23 with some distance therefrom.

Optical printer head 21 and condensing optical system 22 move at a constant speed in parallel and relatively to photosensitive member 2', for example in a moving direction indicated by the arrow in FIG. 9. Condensing optical system 22 may be any which can efficiently irradiate photosensitive member 23 with light output from the light-emitting elements of optical printer head 21. Such optical systems include, for example, an optical fiber array, a SELFOC lens array, a micro lens array, or the like.

Figure 10:
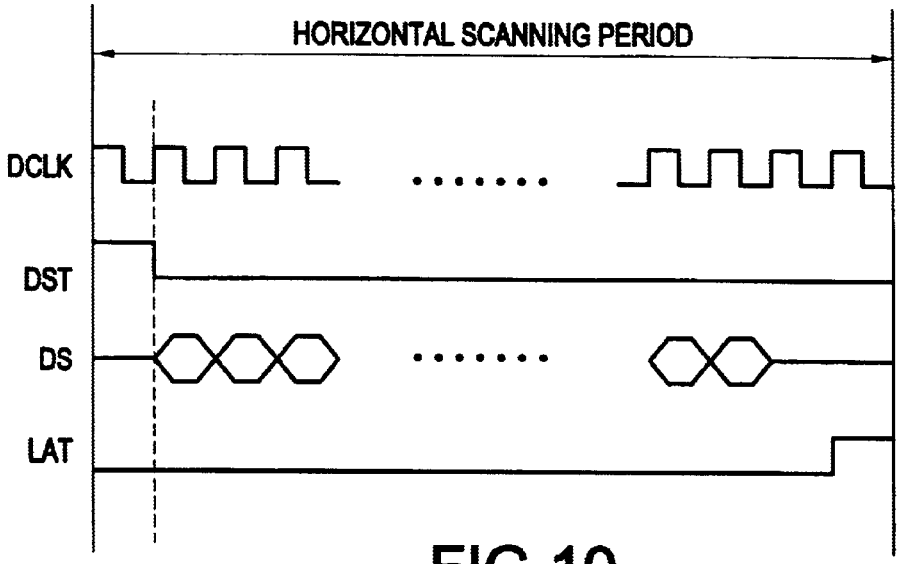
FIG. 10 is a timing chart for illustrating a method for driving the horizontal scanning circuit.

Next, description is made for a method of driving the aforementioned optical printer head. FIG. 10 shows driving timing of horizontal scanning circuit 3, while FIGS. 11 to 14 show timing of signals at the sections of the optical printer head. FIGS. 15A to 15D are provided for describing an exposure operation based on a relative positional relationship between optical printer head 21 and photosensitive member 23. FIG. 16 shows changes over time in potential at a spot on the surface of the photosensitive member. The following description assumes that time required for photosensitive member 23 to move over the length of one pixel in pixel array 4 is one frame period, time required for scanning the vertical pixel sequence in pixel array 4 and the vertical memory cell sequence in memory array 10 is a vertical scanning period, time required for horizontal scanning circuit 3 to scan all the horizontal pixels is a horizontal scanning period, and time required for writing data to all the pixels in pixel array 4 is a data writing period.

The operation of the optical printer head in this embodiment is characterized by performing, during one frame period, (1) data input, (2) writing to a memory cell, (3) writing from a memory cell to a pixel, and (4) light emission and no emission. Next, the respective operations are described in detail.

The data input is described with reference to FIGS. 6 and 10. Printing data DS comprising a serial signal output from the data input section is supplied to shift register 7 in horizontal scanning circuit 3 in synchronization with horizontal clock DCLK which is a clock signal for driving horizontal scanning circuit 3. Serial data for the horizontal pixels is converted to parallel data and held in latch 8 of horizontal scanning circuit 3.

The parallel data held in latch 8 is supplied to data lines corresponding to horizontal pixel sequences PD1, PD2, . . . , PDm−1, and PDm through buffer 9 with the application of latch signal LAT.

Figure 11:
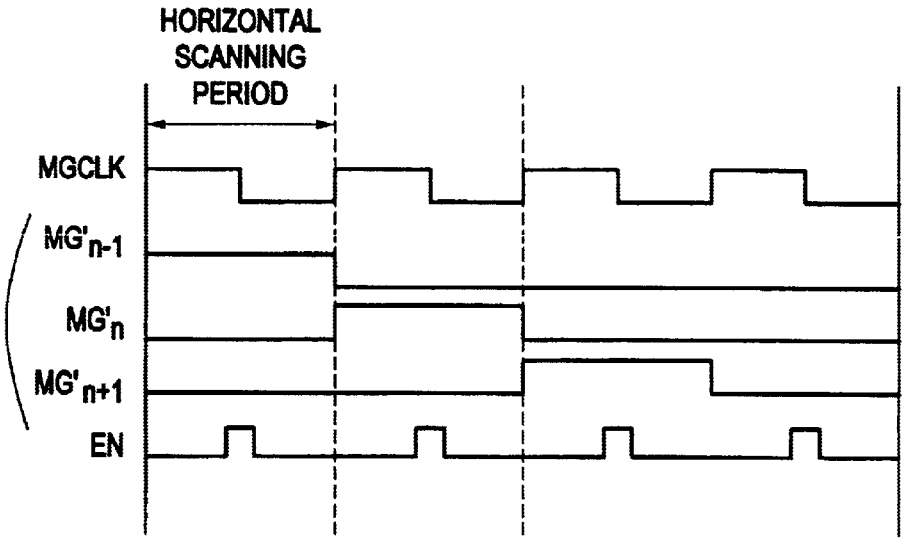
FIGS. 11 to 14 are timing charts illustrating a driving method of the optical printer head shown in FIG. 2.

The writing to a memory cell is described with reference to FIGS. 5, 7 and 11. Vertical scanning circuit 17 for memory writing sequentially scans vertical memory cell sequences MG1' to MGn' in synchronization with vertical clock MGCLK. Vertical scanning circuit 17 for memory writing selects an arbitrary row in the memory array during one frame as shown in FIG. 11. Since writing transistor 31 in a memory cell, if turned on in a period for reading from a memory cell during one frame, causes a malfunction, the output from vertical scanning circuit 17 for memory writing need be off in that period. Thus, switch 29 is used to allow vertical scanning circuit 17 for memory writing to produce output only while switch signal EN is input thereto. This turns on gate G of writing transistor 31 at an arbitrary row in memory array 10 to store binary data in capacitor 34.

Figure 12:
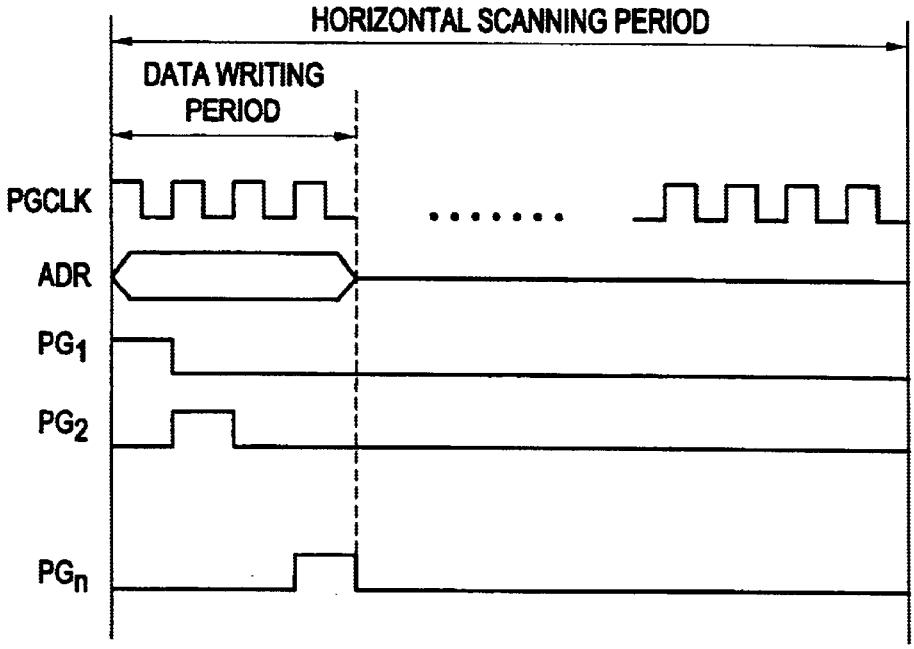

The writing from a memory cell to a pixel or data transfer is described with reference to FIGS. 3, 4, 7, 12 and 13. Vertical scanning circuit 2 for memory reading sequentially scans memory array 10 from a specified row in the vertical direction in response to the input of address data ADR in a data writing period as shown in FIG. 12.

Figure 13:
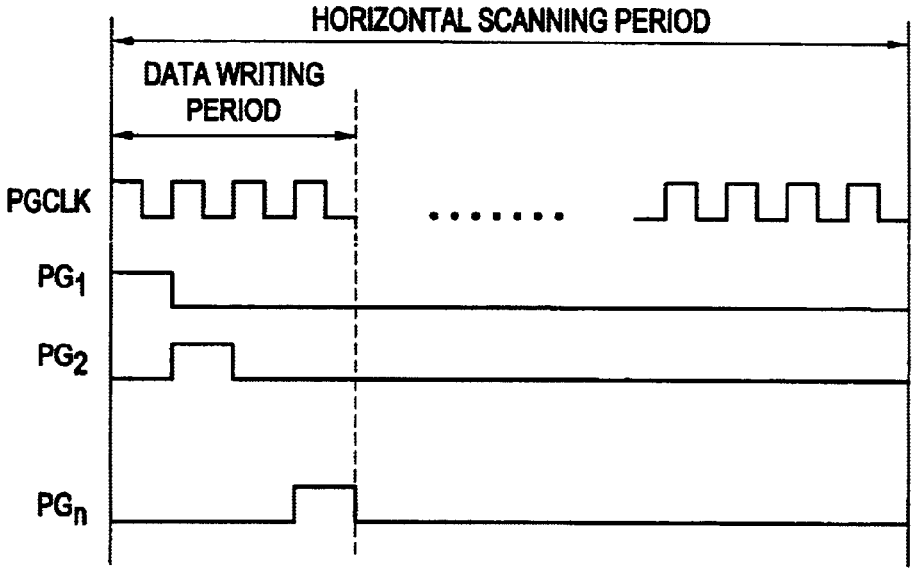

As reading transistor 32 in each memory cell is turned on with the output from vertical scanning circuit 2 for memory reading, binary data held in CMOS (complimentary metal-oxide-semiconductor) inverter 33 is output through reading transistor 32 and reading data line 38. On the other hand, as shown in FIG. 13, vertical scanning circuit 15 for the pixel array sequentially scans the vertical pixel sequences from PG1 to PGn in synchronization with vertical clock PGCLK in a data writing period. Consequently, driving pulses are applied to the gate of selecting transistor 13 in each pixel in pixel array 4 to activate each pixel. The activation means that turning on selecting transistor 13 causes a light-emitting element in each pixel to enter a state where it can emit light or emit no light in accordance with printing data provided through driving transistor 12. The data writing period is preferably short in consideration of crosstalk between pixels.

Figure 14:
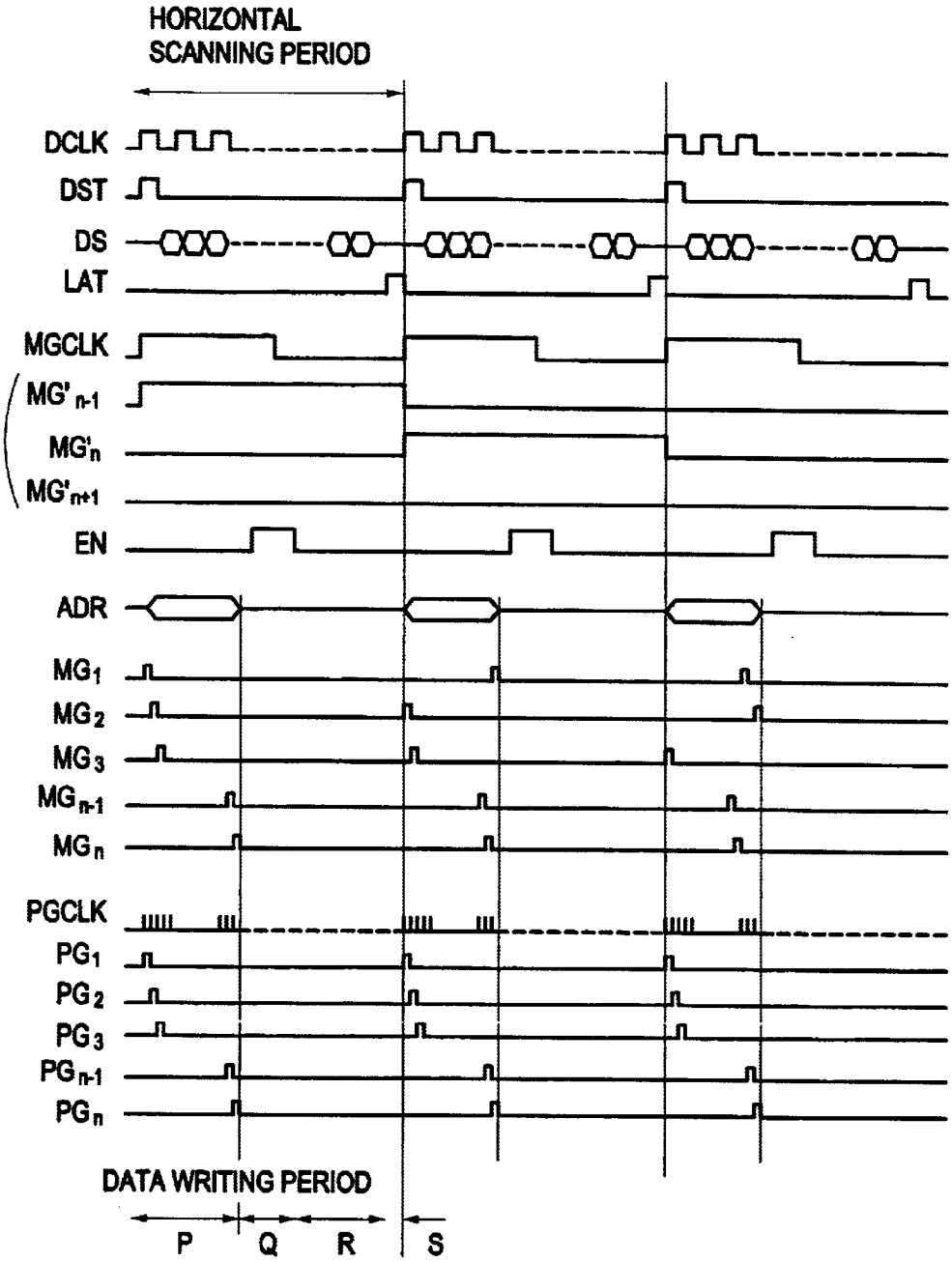

The driving of the optical printer head in one horizontal scanning period has been described. Next, description is made for the general flow of the driving of the optical printer head with reference to FIG. 14. FIG. 14 shows signals at horizontal scanning circuit 3 and vertical scanning circuits 2, 15, 17 in three consecutive horizontal scanning periods.

The operations of horizontal scanning circuit 3 and vertical scanning circuit 15 for the pixel array do not vary from one horizontal scanning period to another. On the other hand, vertical scanning circuit 17 for memory writing selects an arbitrary memory cell row in each horizontal scanning period. Vertical scanning circuit 2 for memory reading sequentially selects memory cells in synchronization with vertical scanning circuit 15 for the pixel array during a data writing period. Vertical scanning circuit 2 for memory reading starts reading from a row shifted by one row in the next horizontal scanning period. In the example shown in FIG. 14, vertical scanning circuit 2 for memory reading initially selects vertical memory cell sequence MG1 in the first horizontal scanning period. In the next horizontal scanning period, vertical scanning circuit 2 for memory reading initially selects vertical memory cell sequence MG2, then vertical memory cell sequence MG3, MG4, . . . , MGn in turn, and finally vertical memory cell sequence MG1. In the next horizontal scanning period, vertical memory cell sequence MG3 is initially selected and vertical memory cell MG2 is finally selected.

FIGS. 17A to 17D are schematic diagrams for describing progression of printing data in the optical printer head with one horizontal scanning period divided into four. FIGS. 17A to 17D show the operating states of horizontal scanning circuit 3, memory array 10, buffer 16, and pixel array 4.

This embodiment requires rewriting of data in all the pixels in pixel array 4 during one frame. Printing data is shifted in a direction indicated by arrows in FIGS. 17A to 17D following the movement of opposite photosensitive member 23.

Figure 17A:
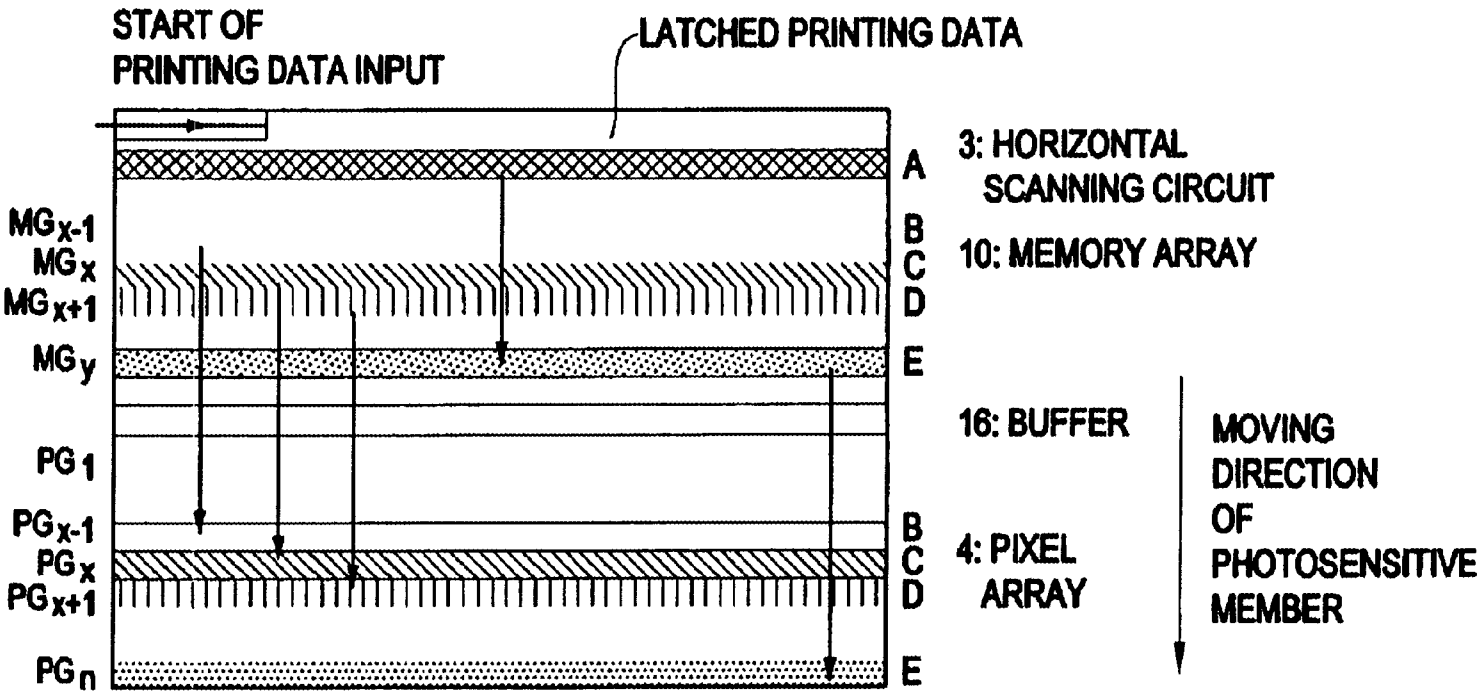
FIGS. 17A to 17D are schematic views illustrating progression of printing data in the optical printer head shown in FIG. 2.

FIG. 17A shows a state from the start of a horizontal scanning period to the end of a data writing period corresponding to period P in FIG. 14. In the horizontal scanning period, printing data is input from the printing data input section (not shown). Printing data A which was latched in the preceding horizontal scanning period is held in the latch.

For describing data flows in memory cell rows in memory array 10, it is assumed that printing data held in vertical memory cell rows MGx−1, MGx, MGx+1, and MGy are B, C, D, and E, respectively. These printing data are written to vertical pixel sequences PGx−1, PGx, PGx+1, and PGn in pixel array 4, respectively. Since vertical pixel sequence PGn is the final row in pixel array 4, printing data E written thereto becomes unnecessary after this horizontal scanning period.

Figure 17B:
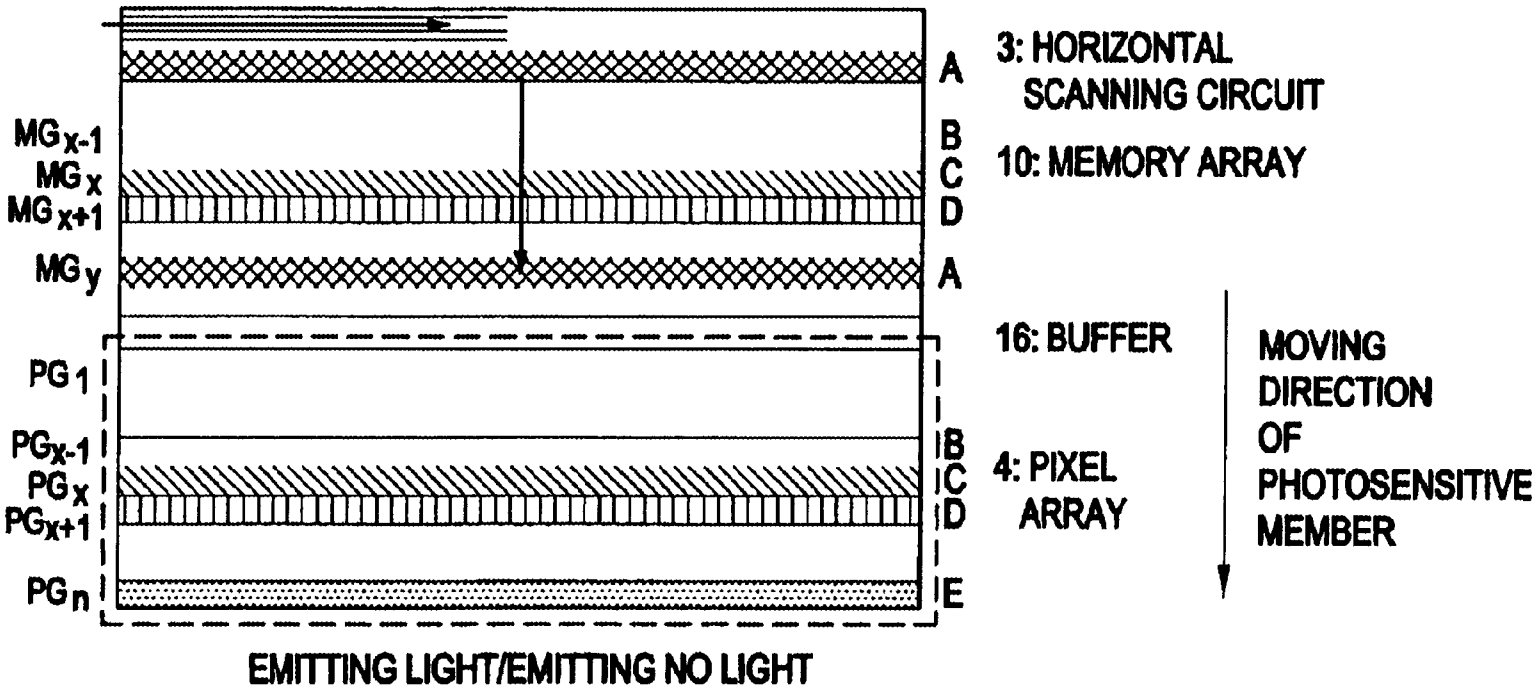

FIG. 17B shows a state at the end of data writing corresponding to period Q in FIG. 14. Printing data A latched in horizontal scanning circuit 3 is written to vertical memory cell row MGy to perform update of printing data E. In the meantime, each pixel in pixel array 4 is activated in accordance with printing data.

Figure 17C:
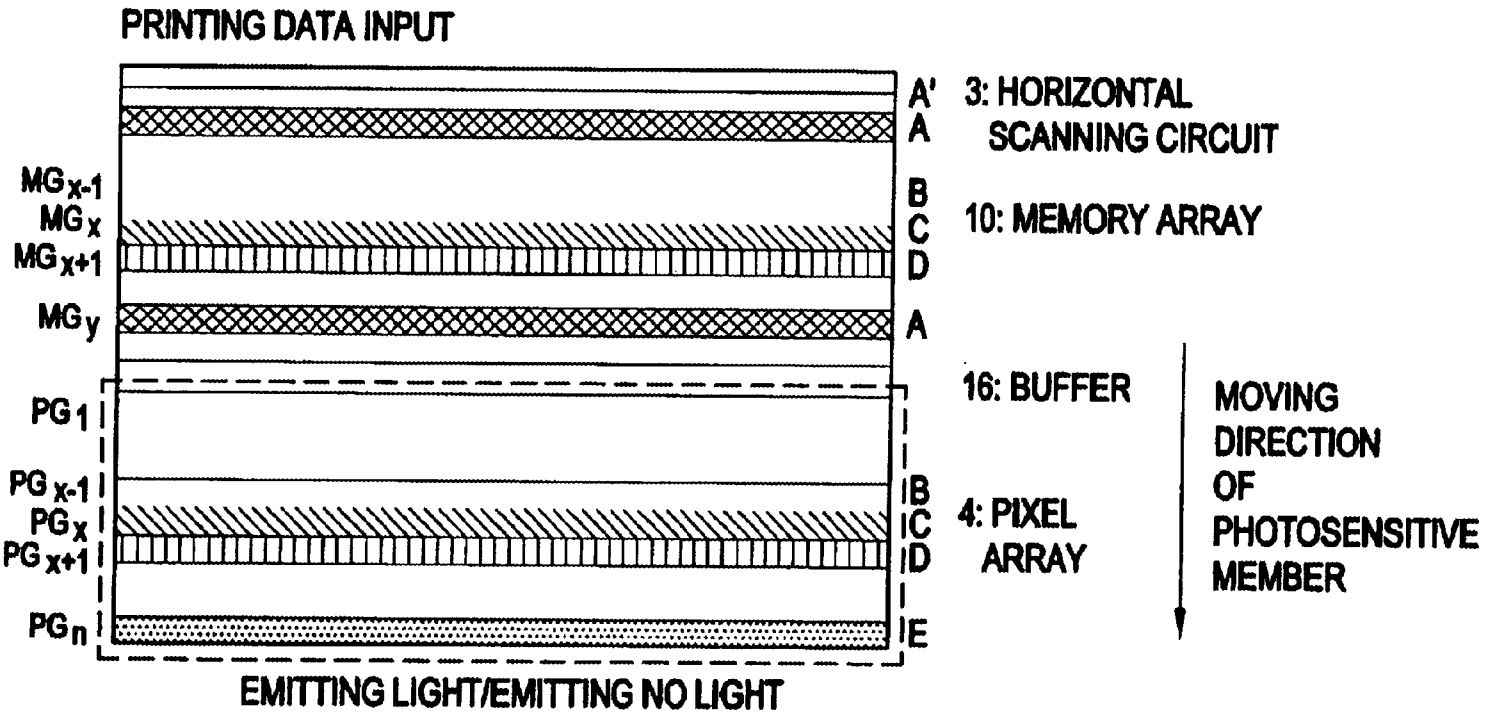

FIG. 17C shows a state corresponding to period R in FIG. 14 in which the input of printing data to horizontal scanning circuit 3 is finished. In this period, no data is passed from memory array 10 to pixel array 4, and each pixel is activated in pixel array 4 subsequently to period Q in FIG. 14.

Figure 17D:
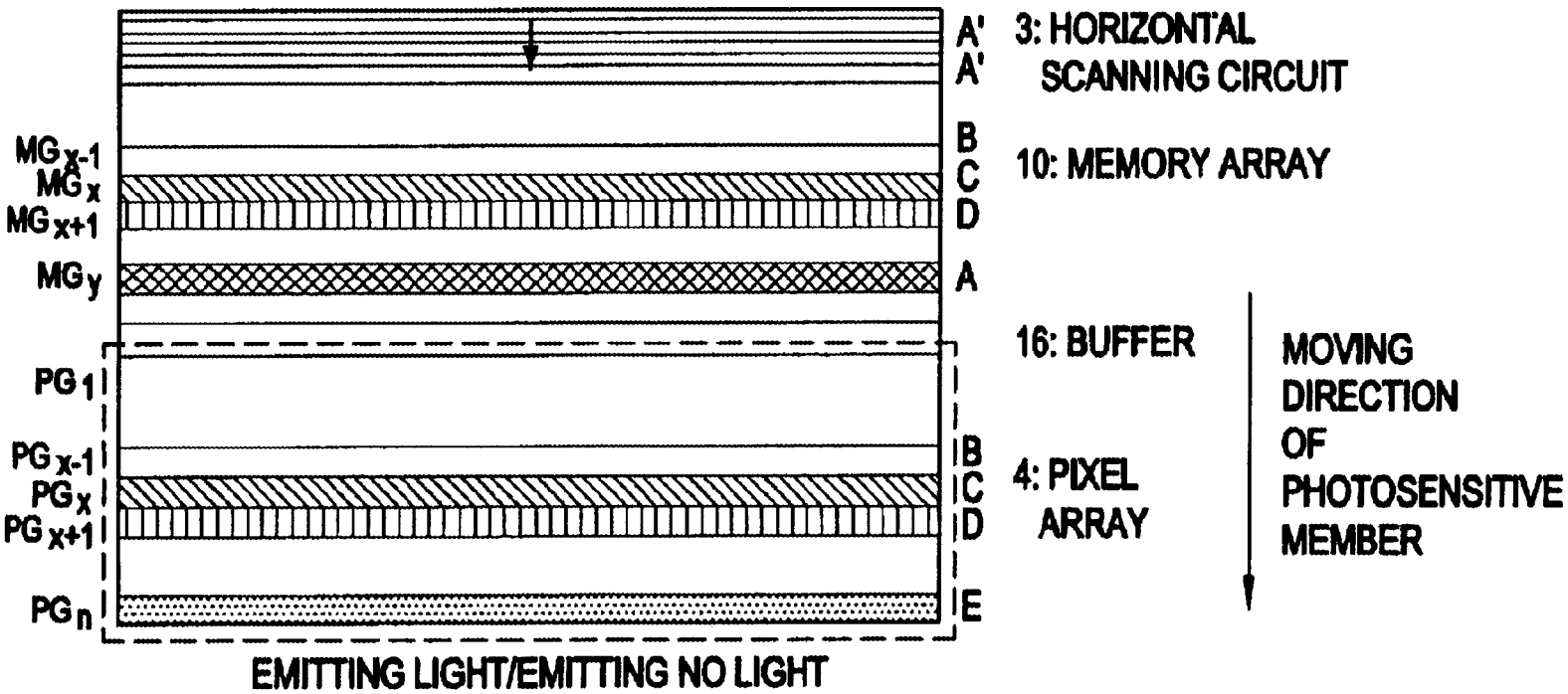

FIG. 17D shows the remainder of the horizontal scanning period corresponding to period S in FIG. 14. Latch signal LAT is applied to horizontal scanning circuit 3 to hold printing data A' already input thereto in the latch of horizontal scanning circuit 3. In this period, no data is passed from memory array 10 to pixel array 4, and each pixel is activated in pixel array 4 subsequently to period R in FIG. 14.

With the use of the aforementioned driving method, when a printing data signal is applied from memory array 10 through pixel data line 41 to the drain of selecting transistor 13 in the pixel in a state where driving pulses (a scanning signal for pixel array 4) is input from vertical scanning circuit 2 through pixel scanning line 40 during the horizontal scanning period, the printing data signal passes through selecting transistor 13 and is held in capacitor 14.

As the input of the driving pulses from vertical scanning circuit 2 is stopped, selecting transistor 13 is turned off. Driving transistor 12 is turned on when capacitor 14 has a high potential, and thus a current passes through the electrode of light-emitting element 11 from power line 50 to cause light-emitting element 11 to emit light. On the other hand, when capacitor 14 has a low potential, driving transistor 12 is turned off. In this case, no current passes through the electrode of light-emitting element 11 to cause light-emitting element 11 to emit no light. Such light emission or no emission continues until the next horizontal scanning period after the end of the supply of the driving pulses from pixel scanning line 40. The light emission or no emission results in writing of a printing data image onto the surface of photosensitive member 23.

FIGS. 15A to 15D show how photosensitive member 23 opposite to optical printer head 21 is exposed to light when the optical printer head is driven as described above. It is assumed for simplification that optical printer head 21 has light-emitting elements (LEES) $\mathbf{11}_1$, $\mathbf{11}_2$ formed along a relative moving direction of photosensitive member 23 to optical printer head 21. Condensing optical system 22 is disposed between optical printer head 21 and photosensitive member 23.

As shown, optical printer head 21 operates in a range in which the surface of optical printer head 21 and the surface of photosensitive member 23 can be regarded as a pair of parallel plates. Assuming that small spot 69 is present on the surface of photosensitive member 23, spot 69 is considered on the move in parallel at a constant speed in a direction determined by the rotation of drum-shaped photosensitive member 23.

Figure 15A:
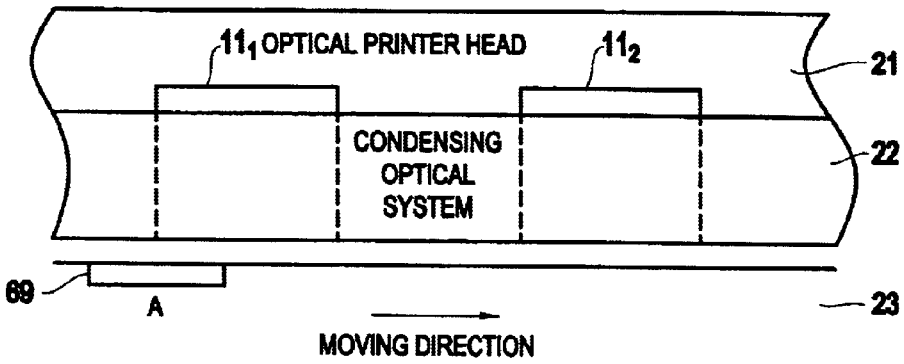
FIGS. 15A to 15D are schematic diagrams for describing an exposure operation in the first embodiment.
Figure 15B:
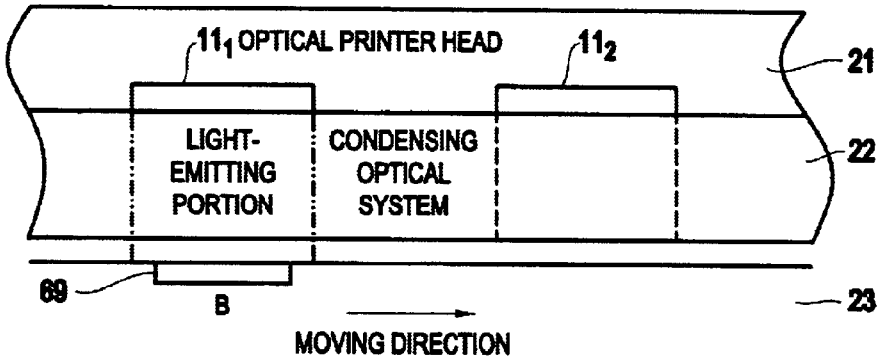
Figure 15C:
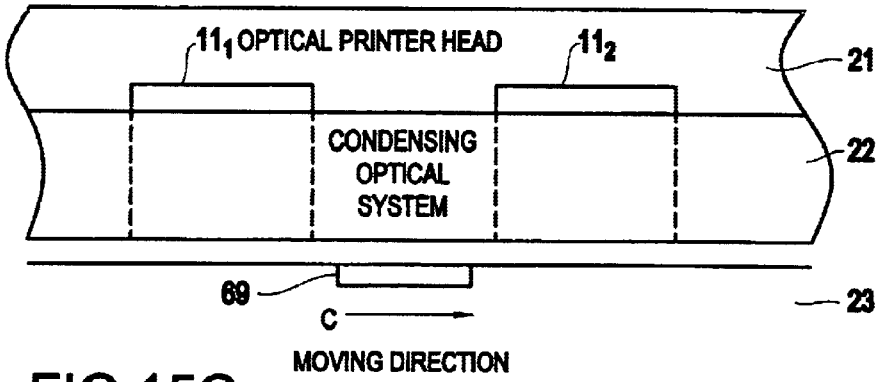
Figure 15D:
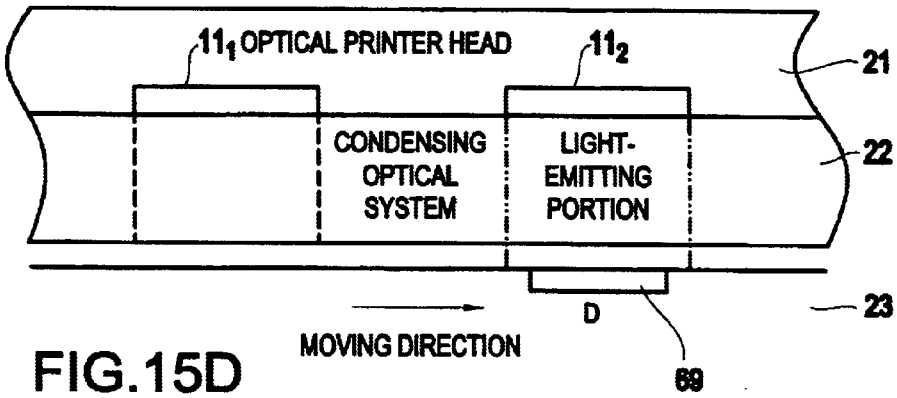
Figure 16:
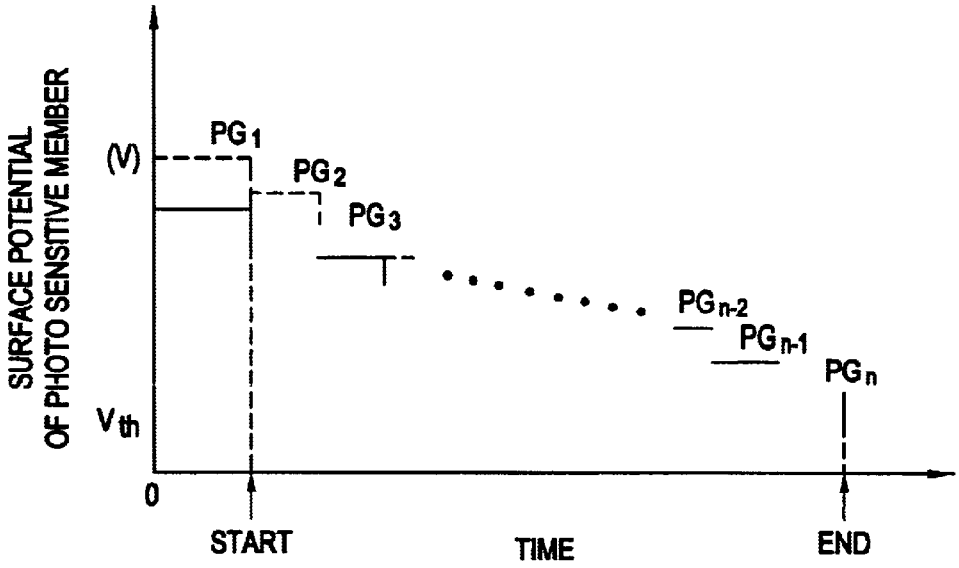
FIG. 16 is a graph showing potential changes at a spot on the surface of a photosensitive member.

Spot 69 is assumed to be at position A initially as shown in FIG. 15A. In this state, spot 69 is not located under light-emitting element $\mathbf{11}_1$ or $\mathbf{11}_2$, and each of light-emitting elements $\mathbf{11}_1$, $\mathbf{11}_2$ emits no light. Then, as show in FIG. 15B, when spot 69 moves to position B under light-emitting element $\mathbf{11}_1$, light-emitting element $\mathbf{11}_1$ is controlled to emit light, thereby irradiating spot 69 with the light from light-emitting element $\mathbf{11}_1$. Subsequently, in a state where spot 69 moves to position C as shown in FIG. 15C, light-emitting element $\mathbf{11}_1$ emits no light. As shown in FIG. 15D, when spot 69 moves to position D under light-emitting element $11_2$, light-emitting element $11_2$ is controlled to emit light, thereby irradiating spot 69 with the light from light-emitting element $11_2$.

Photosensitive member 23 has been charged with a potential from several hundreds to one thousand volts. When spot 69 is irradiated with the light from light-emitting elements $11_1$ and $11_2$, the potential on the surface of photosensitive member 23 is lowered in the area of spot 69 in accordance with the amount of the light, the sensitivity of photosensitive member 23, and the like. Such an operation causes the potential on the surface of photosensitive member 23 to be decreased stepwise in accordance with the degree of exposure as shown in FIG. 16. PG1, PG2, . . . , PGn−1, and PGn in FIG. 16 correspond to row numbers PG1, PG2, . . . , PGn−1, and PGn in FIG. 2, respectively.

At the start point, data writing is started from the first row, and pixels in the first row emit light to exposure photosensitive member 23 to the light. The exposure operation is performed for pixels in each row sequentially in response to the driving pulses from vertical scanning circuit 2. The potential on the surface of photosensitive member 23 is lowered stepwise, and when it reaches the potential indicated as threshold voltage $V_{th}$ in FIG. 16, the exposure operation is finished. Threshold voltage $V_{th}$ is a threshold voltage required for the exposure determined by the characteristics of photosensitive member 23 and the characteristics of the development process.

In this manner, according to the first embodiment, a plurality of light-emitting elements $11_1$, $11_2$ are used to expose the same spot 69 to light continuously and cumulatively. Thus, a desired amount of light exposure can be achieved even if each of light-emitting elements $11_1$, $11_2$ emits a small amount of light. In addition, with the use of memory array 10, printing data corresponding to all the pixels of pixel array 4 are held therein to enable a fast reading operation by reading the data therefrom.

Since the optical printer head according to the first embodiment has, on the same insulator substrate 1, the thin film light-emitting element array with a two-dimensional arrangement or pixel array 4, memory array 10 with a similar two-dimensional arrangement, and the driving circuit for driving thereof, a higher density and a smaller size can be achieved. In addition, the same spot 69 on photosensitive member 23 can be subjected to a plurality of exposures to light with the plurality of light-emitting elements in the vertical scanning direction. For this reason, a desired amount of light exposure can be achieved even if each of light-emitting elements $11_1$, $11_2$ emits a small amount of light, thereby allowing an even faster reading operation.

Figure 18:
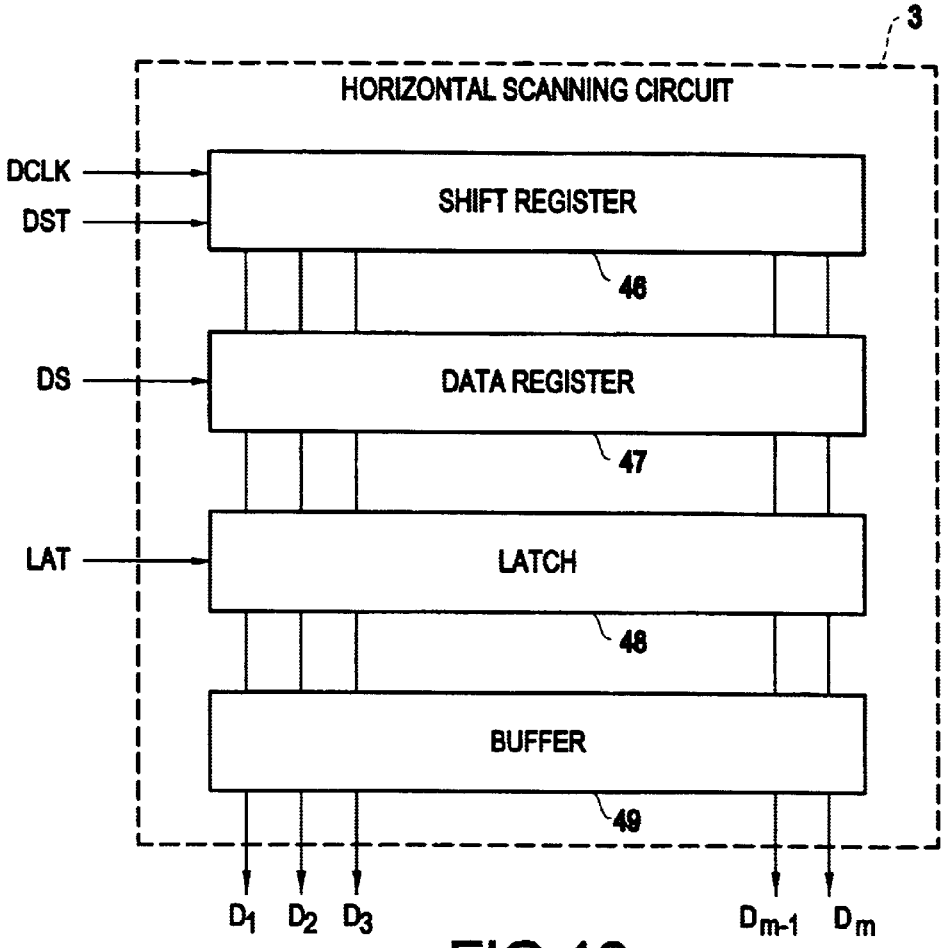
FIG. 18 is a block diagram showing a configuration of a horizontal scanning circuit in an optical printer head according to a second embodiment of the present invention.

Next, description is made for an optical printer head according to a second embodiment of the present invention. The optical printer head of the second embodiment is similar to the optical printer head of the first embodiment except for the inner configuration of horizontal scanning circuit 3. FIG. 18 shows the configuration of horizontal scanning circuit 3 in the optical printer head of the second embodiment. The printer head also comprises a vertical scanning circuit for memory writing, a vertical scanning circuit for memory reading, a vertical scanning circuit for a pixel array, pixels, and memory cells. The configurations of these components are similar to those shown in FIGS. 3, 4, 5, 7 and 8. An exposure operation using the optical printer head is also similar to that in the first embodiment.

Horizontal scanning circuit 3 comprises shift register 46, data register 47, latch 48, and buffer 49. Shift register 46 includes a plurality of binary elements arranged in the horizontal direction corresponding to horizontal pixel sequences, and sequentially transfers start signal DST horizontally in response to horizontal clock DCLK. Data register 47 includes a plurality of binary elements arranged in the horizontal direction corresponding to the horizontal pixel sequences, and sequentially shifts printing data DS comprising a serial signal of m bits in the horizontal direction in response to pulses output from shift register 46. Latch 48 includes a plurality of holding elements arranged in the horizontal direction corresponding to the horizontal pixel sequences, latches output data from the respective binary elements in data register 47, and outputs the latched data in response to latch signal LAT. Buffer 49 includes a plurality of amplifying elements arranged in the horizontal direction corresponding to the horizontal pixel sequences, amplifies the data held by the respective holding elements in latch 48, and produces outputs corresponding to horizontal pixel sequences MD1, MD2, . . . , MDm−1, and MDm of memory array 10.

When the optical printer head in the second embodiment is driven, only start signal DST is transmitted within shift register 46. Start signal DST includes a single pulse and is slightly affected by a resistance load and a capacitive load during the transmission. Thus, according to the second embodiment, faster input and transfer of printing data than the first embodiment can be achieved.

Next, description is made for an optical printer head according to a third embodiment of the present invention. The optical printer head of the third embodiment is similar to the optical printer head of the first embodiment, and its exposure operation is also similar to that of the first embodiment. However, each of pixels constituting pixel array 4 includes a single light-emitting element in the first and second embodiments, but in the optical printer head of the third embodiment, each of pixels constituting pixel array 4 is driven in sub-pixel groups each formed of a plurality of sub-pixels. In the printer head of the third embodiment, an amount of light emitted by each pixel can be changed gradationally by controlling the number of sub-pixels which actually emit light in each of the sub-pixel groups. The optical printer head in the third embodiment greatly differs from the optical printer heads in the first and second embodiments in that point.

Figure 19:
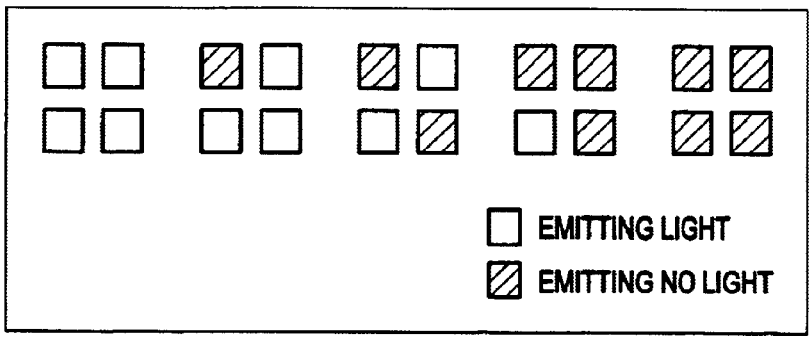
FIG. 19 is a schematic diagram for describing a configuration of each pixel and the operation thereof in an optical printer head according to a third embodiment of the present invention.

The operation of the optical printer head of the third embodiment is hereinafter described with reference to FIG. 19. In this case, pixels of n rows and m columns constituting pixel array 4 are divided into sub-pixel groups each including sub-pixels of k rows and j columns (each of k, j is an integer equal to or greater than 2), and each of these sub-pixel groups is operated as a minimum pixel unit at the time of printing. The number of driven sub-pixels is controlled for each sub-pixel group to vary the number of light-emitting elements emitting light, thereby making it possible to change an amount of emitted light for each sub-pixel group in multiple levels. FIG. 19 shows a pixel of k=2 and j=2, i.e. when each sub-pixel group comprises sub-pixels of two rows and two columns, and illustrates that five levels of emitted light can be obtained from the sub-pixel groups from all of four light-emitting elements emitting light to none of four light-emitting elements emitting light. With such a configuration, photosensitive member 23 can be exposed to five levels of light for each spot 69 to allow realization of gradation printing.

Since the execution of gradation printing typically requires, as input data, information for obtaining an amount of emitted light which changes in an analog fashion, multi-level gradation representation involves an increased amount of input data and a significantly increased scale of a driving circuit. However, according to the third embodiment, multi-level gradation printing can be performed using a relatively simple driving circuit and binary data as input. In this manner, in the optical printer head of the third embodiment, each of pixels constituting pixel array 4 is divided into a group of sub-pixels including a plurality of sub-pixels, and the number of sub-pixels emitting light can be controlled in each sub-pixel group. It is thus possible to provide an optical printer head capable of multi-level gradation printing with binary data used as input.

Figure 20:
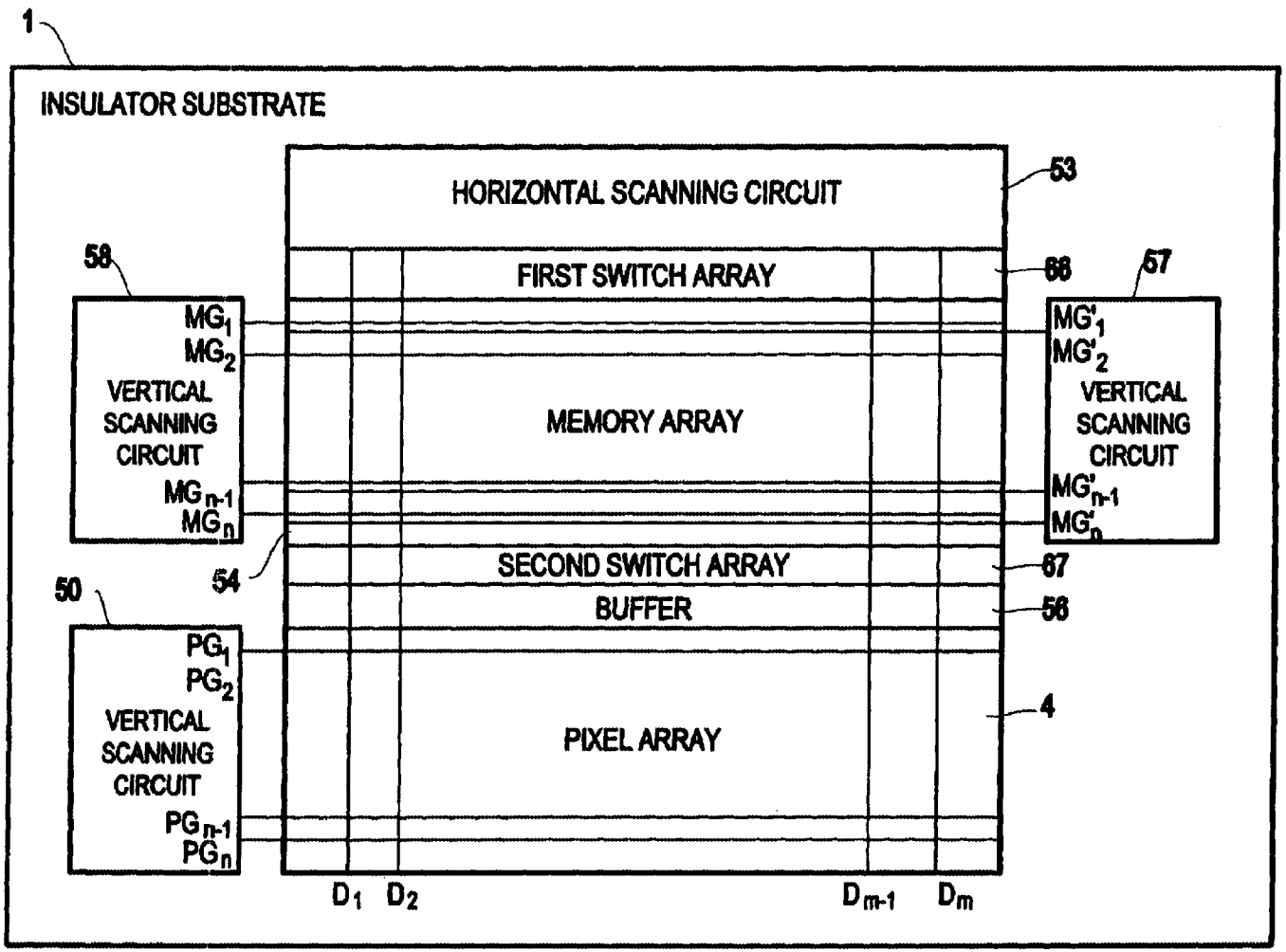
FIG. 20 is a block diagram showing a configuration of an optical printer head according to a fourth embodiment of the present invention.

Next, description is made for an optical printer head according to a fourth embodiment of the present invention with reference to FIG. 20. The optical printer head of the fourth embodiment generally comprises insulator substrate 1, horizontal scanning circuit 53, first switch array 66, memory array 54, second switch array 67, buffer 56, pixel array 4, vertical scanning circuit 58 for memory reading, vertical scanning circuit 50 for the pixel array, and vertical scanning circuit 57 for memory writing. First switch array 66 is inserted on a transfer path between horizontal scanning circuit 53 and memory array 54. Second switch array 67 is inserted on a transfer path between memory array 54 and pixel array 4. In the shown example, second switch array 67 is formed on the input side of buffer 56.

Vertical scanning circuits 57, 58, 50, pixel array 4, and buffer 56 have configurations similar to those of vertical scanning circuits 17, 2, 15, pixel array 4, and buffer 30 in the first embodiment, respectively. Horizontal scanning circuit 53 may be configured similarly to the horizontal scanning circuit in the first embodiment shown in FIG. 6, or to the horizontal scanning circuit in the second embodiment shown in FIG. 18. An exposure operation in the fourth embodiment is basically similar to the exposure operation in the first embodiment.

As a result, the optical printer head in the fourth embodiment is characterized in that it differs from the optical printer head in each of the aforementioned embodiments in the provision of first switch array 66 and second switch array 67, and in the configuration of memory cells 68 constituting memory array 54.

Figure 21:
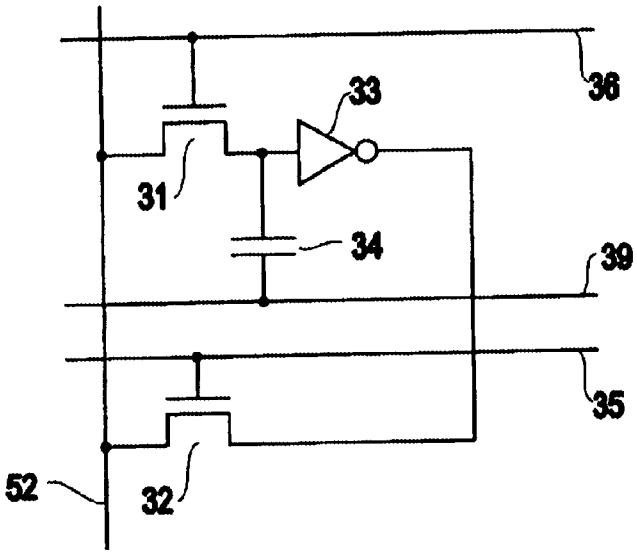
FIG. 21 is a circuit diagram showing an example of a configuration of a memory cell in FIG. 20.

FIG. 21 shows an example of the configuration of memory cell 68. Memory cell 68 comprises writing transistor 31, reading transistor 32, inverter 33, capacitor 34, writing scanning line 35, reading scanning line 36, capacitance line 39, and data line 52. Writing transistor 31 has gate G connected to reading scanning line 36, source S connected to data line 52, and drain D connected to input to inverter 33 and capacitor 34, respectively. Capacitor 34 is connected to capacitance line 39. Reading transistor 32 has gate G connected to writing scanning line 35, source S connected to output from inverter 33, and drain D connected to data line 52, respectively. It should be noted that the configuration of memory cell 68 is not limited to that shown in FIG. 21.

Each of first switch array 66 and second switch array 67 includes binary elements arranged corresponding to memory cell rows in memory array 54 for selecting arbitrary timing and a high level or a low level. While logical gates such as NAND gates or NOR gates are typically used as each switch array, other configurations may be used as long as pulse-controlled switching is possible.

Figure 22:
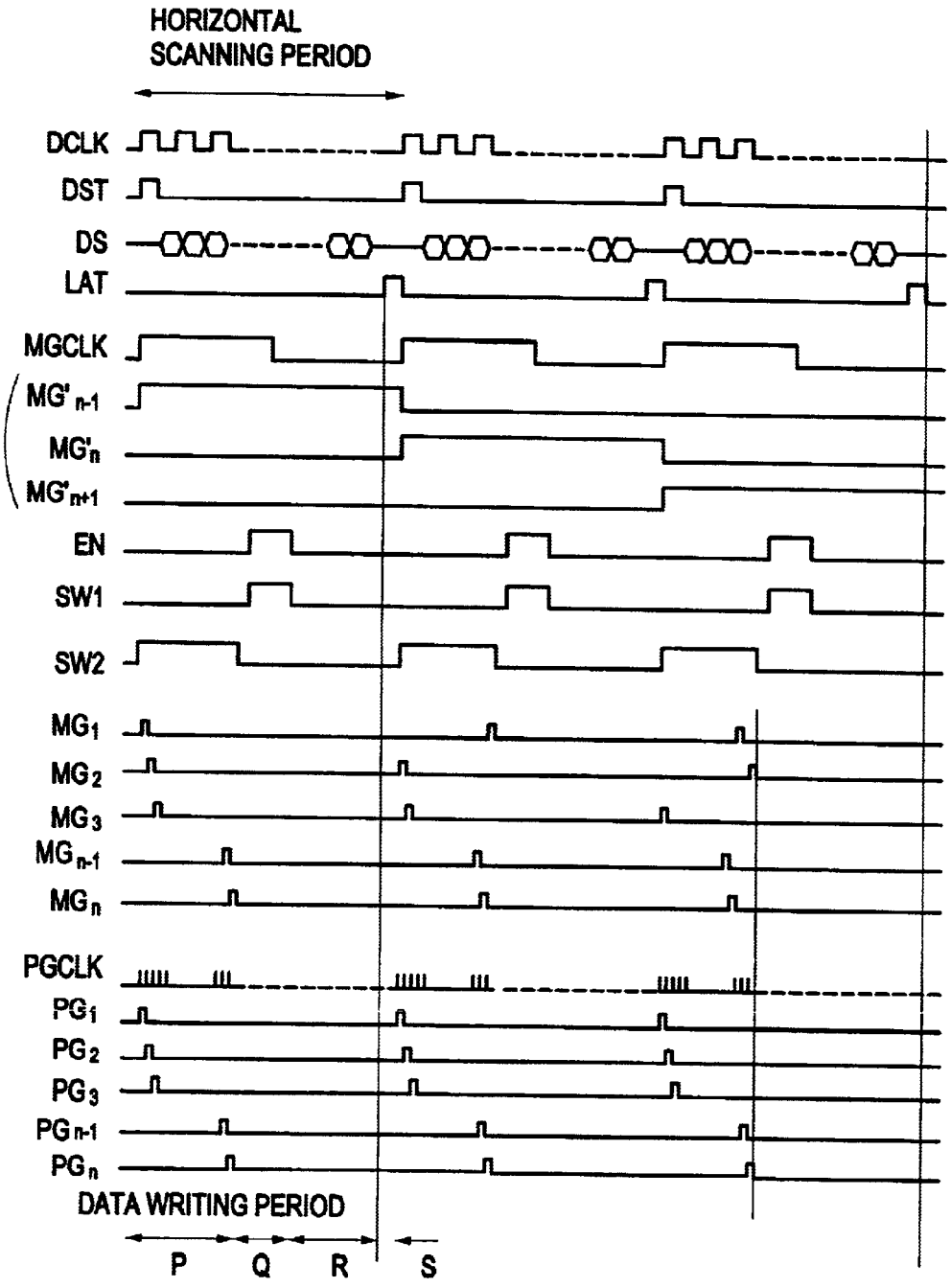
FIG. 22 is a timing chart illustrating a method for driving the optical printer head shown in FIG. 20.

A method for driving the optical printer head of the fourth embodiment is described with reference to FIG. 22.

Signals SW1, SW2 are applied to first switch array 66 and second switch array 67, respectively. Signal SW1 is on when printing data for one row latched in horizontal scanning circuit 52 is written to memory cell 68, i.e. in period Q in FIG. 22, while signal SW2 is off during this period. This can prevent erroneous writing to pixel array 4. Conversely, signal SW2 is on when writing is performed from memory array 54 to pixel array 4, i.e. in period P in FIG. 22, while signal SW1 is off during this period. In such a driving method, when pixel array 4 is not affected even if signal SW2 is on in writing printing data for one row latched in horizontal scanning circuit 52 to memory cell 68, second switch array 67 may be eliminated in the circuit configuration.

In this manner, according to the fourth embodiment, it is possible to provide an optical printer head which does not cause erroneous writing even when the memory cell employs the structure including one data line serving both as a writing data line and a reading data line.

Figure 23:
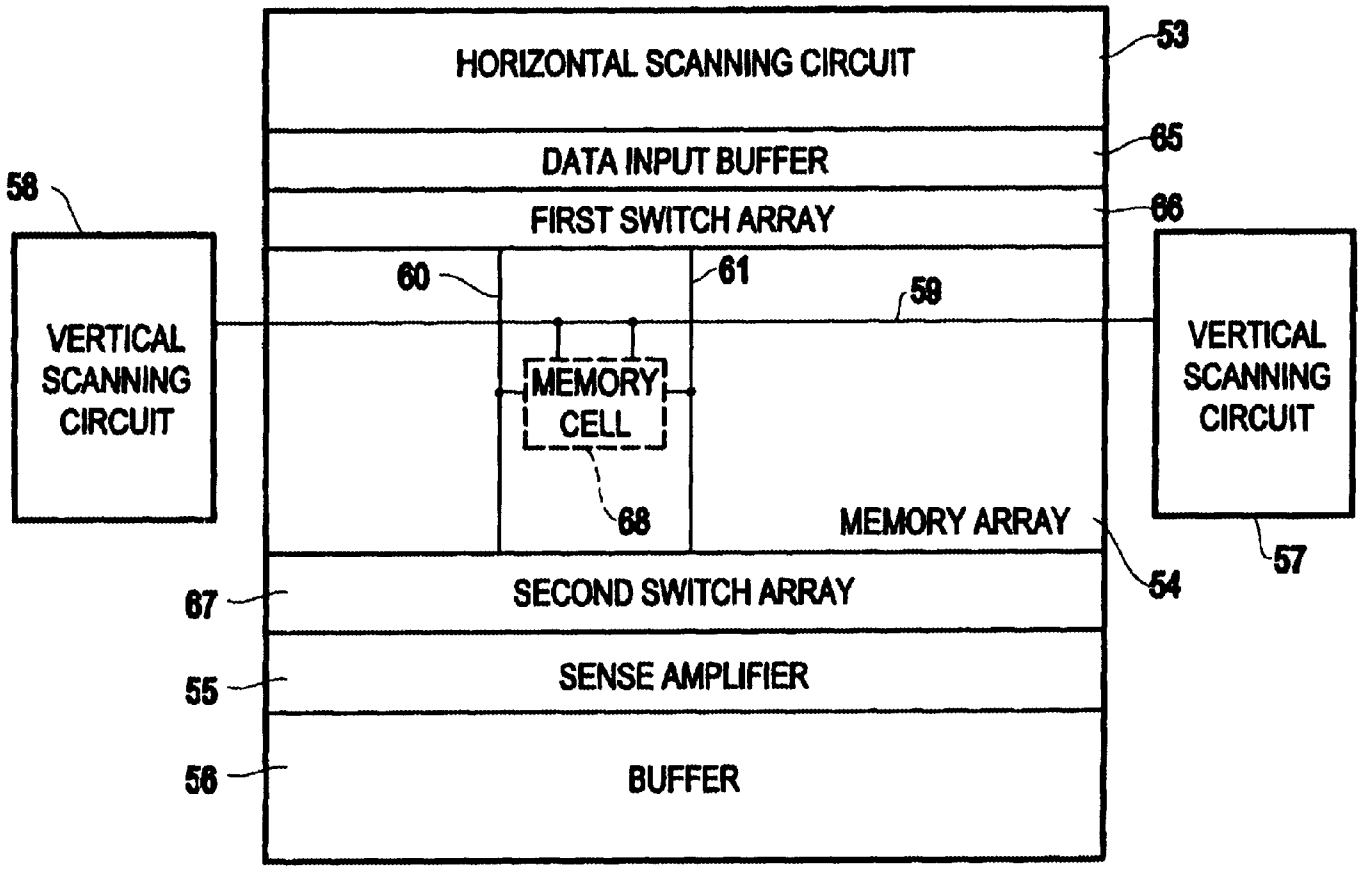
FIG. 23 is a block diagram showing a memory array and its peripheral circuits of an optical printer head according to a fifth embodiment of the present invention.

Next, an optical printer head according to a fifth embodiment of the present invention is described. FIG. 23 shows a memory array and its peripheral circuits in the optical printer head of the fifth embodiment. The optical printer head comprises horizontal scanning circuit 53, memory array 54, sense amplifier 55, first switch array 66, data input buffer 65, second switch array 67, buffer 56, vertical scanning circuit 57 for memory writing, and vertical scanning circuit 58 for memory reading. Of these components, horizontal scanning circuit 53, buffer 56, vertical scanning circuit 57 for memory writing, and vertical scanning circuit 58 for memory reading are similar in their configurations and operations to those of the first and second embodiments. First switch array 66 and second switch array 67 are similar in their configurations and operations to those of the fourth embodiment.

Figure 24:
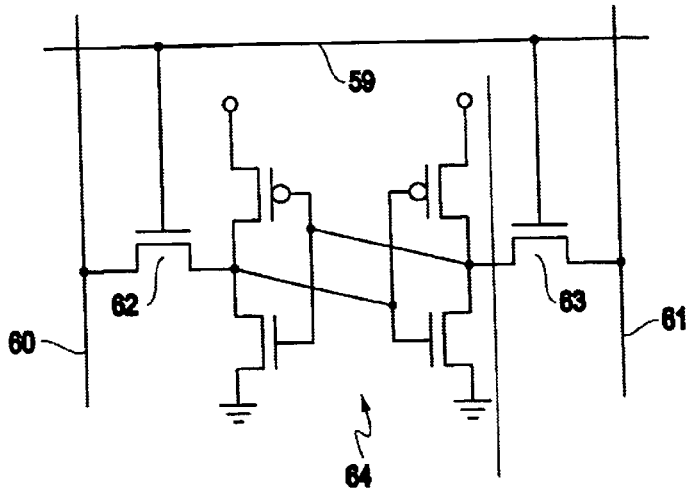
FIG. 24 is a circuit diagram showing an example of a configuration of a memory cell in the memory array shown in FIG. 23.

FIG. 24 shows an example of the configuration of memory cell 68 of memory array 54 in the optical printer head of the fifth embodiment. In the shown example, memory cell 68 comprises first transistor 62, second transistor 63, flip flop circuit 64, gate line 59, first data line 60, and second data line 61. In the fifth embodiment, a usual static RAM (SRAM) configuration is used for memory cell 68, and for example, a complete CMOS configuration as mentioned above is used.

Figure 25:
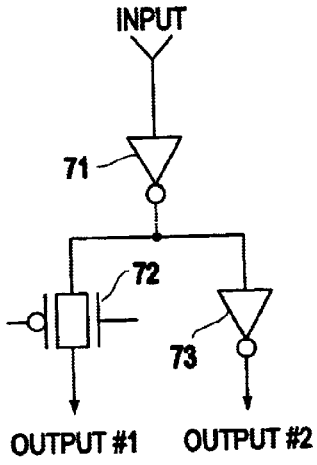
FIG. 25 is a circuit diagram showing an example of a configuration of a data input buffer.

FIG. 25 shows an example of the configuration of data input buffer 65. Data input buffer 65 comprises at least two inverters 71, 73, and one transfer gate 72. The circuit obtains two opposite binary outputs from one input. For example, output #1 becomes high and output #2 becomes low when input is high, and in contrast, when input is low, output #1 becomes low and output #2 becomes high.

Figure 26:
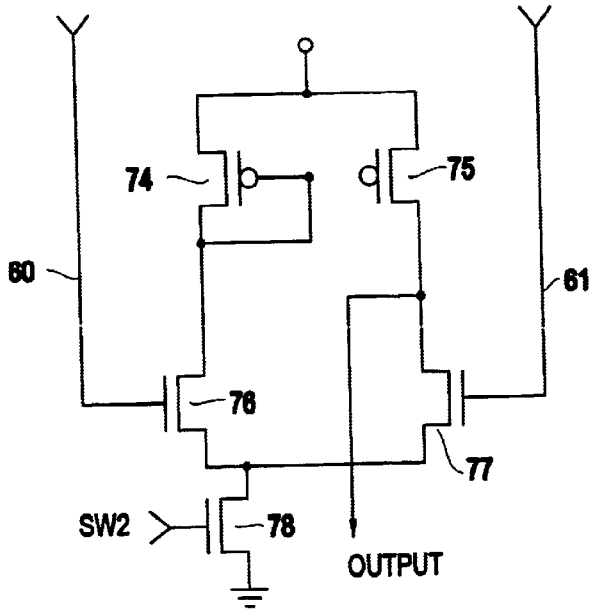
FIG. 26 is a circuit diagram showing an example of a configuration of a sense amplifier.

FIG. 26 shows an example of the configuration of sense amplifier 55. Sense amplifier 55 is a circuit for amplifying a potential difference between outputs from first data line 60 and second data line 61 in memory cell 68, and comprises transistors 74 to 78.

Description is made for the operations of memory array 54 and its peripheral circuits in the optical printer head of the fifth embodiment with reference to FIGS. 23 to 26.

A writing operation is performed with signal SW1 on and signal SW2 off. As vertical scanning circuit 53 for memory writing selects a memory cell row including memory cell 68, the gates of both first transistor 62 and second transistor 63 are turned on, and printing data is input to flip flop circuit 64 from first data line 60 and second data line 61, and held at left and right storage nodes, respectively.

A reading operation is performed with signal SW1 off and signal SW2 on. As vertical scanning circuit 57 for memory reading selects a memory cell row including memory cell 68, the gates of both first transistor 62 and second transistor 63 are turned on, and printing data held at the storage nodes are output to sense amplifier 55 through first data line 60 and second data line 61, respectively.

Upon receiving the printing data, sense amplifier 55 amplifies a high or low signal in accordance with a potential difference between signals on first data line 60 and second data line 61, and outputs the amplified signal to pixel array 4 through buffer 56.

In this manner, according to the fifth embodiment, it is possible to provide an optical printer head capable of performing operations similar to those of the optical printer head described in the first embodiment even when it uses a static RAM for the memory cell configuration.

Next, an optical printer head according to a sixth embodiment of the present invention is described. The optical printer head of the sixth embodiment is identical in its configuration to the optical printer head in the first embodiment, and the driving method is the only difference between them.

Figure 27:
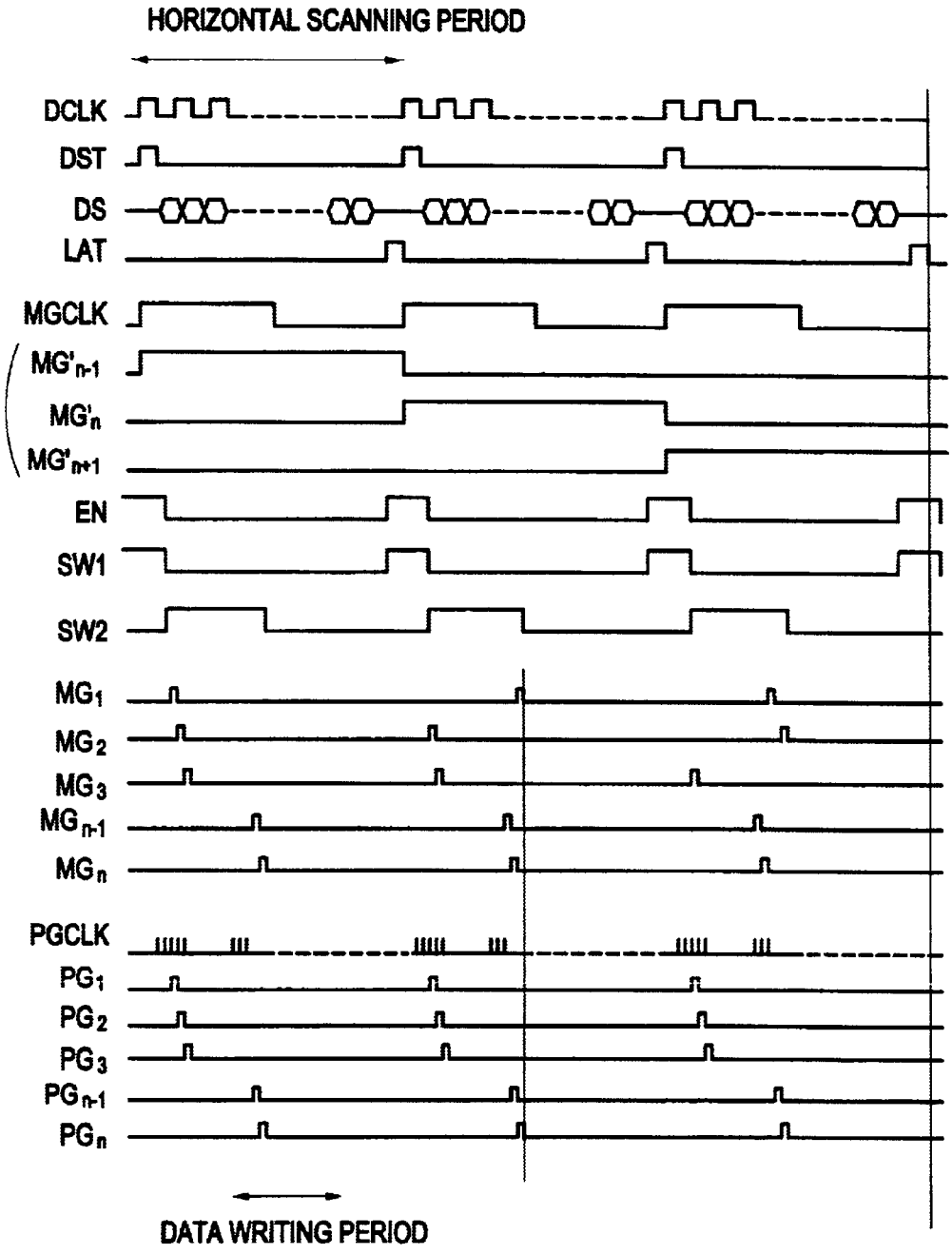
FIG. 27 is a timing chart illustrating a method for driving an optical printer head according to a sixth embodiment of the present invention.

According to the driving method of the first embodiment, printing data for one row in the pixel array input during a horizontal scanning period is written to the memory array in the next horizontal scanning period and to the pixel array in the next horizontal scanning period but one. In contrast, in the driving method of the sixth embodiment, printing data for one row in the pixel array input during a horizontal scanning period is written to the memory array at the start of the next horizontal scanning period and to the pixel array within the same period. The sixth embodiment differs from the first embodiment in that point. FIG. 27 is a timing chart illustrating the driving method of the sixth embodiment.

Input of printing data for one row in the pixel array is started by the application of start signal DST in response to horizontal clock DCLK similarly to the first embodiment, and the input is finished within that horizontal scanning period. Latch signal LAT is applied at the start of the horizontal canning period, and consequently, printing data latched in the preceding horizontal scanning period is transferred to an arbitrary memory cell row in the memory array and held in respective memory cells. After the writing to the memory array, transfer from the memory array to the pixel array is performed similarly to the first embodiment.

In this manner, in the driving method of the optical printer head according to the sixth embodiment, printing data for one row in the pixel array input in a horizontal scanning period is written to the pixel array in the next horizontal scanning period. Thus, light-emitting elements can emit light or emit no light.

While the respective embodiments of the preset invention have been described in detail with reference to the drawings, specific configurations are not limited to those described in the embodiments, and design modifications and the like are included in the present invention without departing the scope or spirit of the present invention. For example, the optical printer head of the present invention can be used not only in electrophotographic systems but also in other computer-based printing systems.

In this manner, according to the optical printer head of the present invention, desired exposure to light can be made at high speed even with a light-emitting element emitting a small amount of light, and multi-level gradation printing can be performed. It is also possible to drive exposure to light in accordance with the surface potential characteristics of the photosensitive member to the amount of exposure to light. In addition, even when an object of printing is inserted with some displacement, the displacement can be corrected by shifting input data in accordance with the amount of the displacement. Multi-level gradation printing can also be realized with binary data input.

What is claimed is:

1. An optical printer head comprising:

a pixel array including pixels arranged two-dimensionally in a row direction and a column direction, each of said pixels including a light-emitting element;

a memory array including memory cells arranged two-dimensionally in a row direction and a column direction for holding printing data input thereto;

a horizontal scanning circuit for supplying a data signal to each memory cell column in said memory array;

a first vertical scanning circuit for sequentially selecting memory cell rows to write binary data to each memory cell in said memory array;

a selecting circuit for arbitrarily selecting said memory cell rows to read binary data from each memory cell in said memory array;

a second vertical scanning circuit for sequentially selecting pixel rows in said pixel array; and a buffer located on a transfer path between said memory array and said pixel array.

2. The optical printer head according to claim 1, wherein said light-emitting element comprises an organic electroluminescence element.

3. The optical printer head according to claim 1, wherein said horizontal scanning circuit, said first vertical scanning circuit, said selecting circuit, said second vertical scanning circuit, said buffer, a first circuit including said memory cells, and a second circuit including said pixels are formed on a single insulator substrate.

4. The optical printer head according to claim 3, wherein said light-emitting element comprises an organic electroluminescence element.

5. The optical printer head according to claim 3, wherein each of said horizontal scanning circuit, said first vertical scanning circuit, said selecting circuit, said second vertical scanning circuit, said buffer, said first circuit, and said second circuit comprises a polycrystalline silicon thin film transistor.

6. The optical printer head according to claim 1, further comprising a switch array located on a transfer path between said horizontal scanning circuit and said memory array.

7. The optical printer head according to claim 6, wherein said horizontal scanning circuit, said first vertical scanning circuit, said selecting circuit, said second vertical scanning circuit, said buffer, said switch array, a first circuit including said memory cells, and a second circuit including said pixels are formed on a single insulator substrate.

8. The optical printer head according to claim 7, wherein said light-emitting element comprises an organic electroluminescence element.

9. The optical printer head according to claim 7, wherein each of said horizontal scanning circuit, said first vertical scanning circuit, said selecting circuit, said second vertical scanning circuit, said buffer, said switch array, said first circuit, and said second circuit comprises a polycrystalline silicon thin film transistor.

10. The optical printer head according to claim 1, further comprising a first switch array located on a transfer path between said horizontal scanning circuit and said memory array, and a second switch array located on a transfer path between said memory array and said pixel array.

11. The optical printer head according to claim 10, wherein said horizontal scanning circuit, said first vertical scanning circuit, said selecting circuit, said second vertical scanning circuit, said buffer, said first switch array, said second switch array, and a first circuit including said memory cells, and a second circuit including said pixels are formed on a single insulator substrate.

12. The optical printer head according to claim 11, wherein each of said horizontal scanning circuit, said first vertical scanning circuit, said selecting circuit, said second vertical scanning circuit, said buffer, said first switch array, said second switch array, said first circuit, and said second circuit comprises a polycrystalline silicon thin film transistor.

13. The optical printer head according to claim 10, wherein said light-emitting element comprises an organic electroluminescence element.

14. A method of driving an optical printer head comprising a pixel array including pixels arranged two-dimensionally in a row direction and a column direction, each of said pixels including a light-emitting element, for selectively irradiating a surface of a rotatable photosensitive member with light in accordance with printing data, and a memory array including memory cells arranged two-dimensionally in a row direction and a column direction for holding printing data input thereto, said method comprising:

in a state where pixel rows said pixel array are in parallel to a rotational axis of said photosensitive member and said light-emitting element emits light in a direction opposed to a surface of said photosensitive member, establishing a state where a spot on the surface of said photosensitive member is irradiated with light or a state where the spot is not irradiated with light by one of light emission and no emission from an n-th pixel, where a is an integer equal to or greater than 1, in said pixel array; and establishing a state where said spot on the surface of said photosensitive member is irradiated with light or a state where said spot is not irradiated with light by one of light emission from an (n+1)-th pixel said pixel array during a period in which said spot passes said (n+1)-th pixel.

wherein said one of light emission and no emission is performed sequentially in said light-emitting elements data in said pixel array by reading printing data from said memory array and writing the printing data to said pixel array.

15. The method according to claim 14, wherein said light-emitting element is formed of an organic electroluminescence element.

16. The method according to claim 14, wherein said photosensitive member comprises a photosensitive drum, said optical printer head further comprises a horizontal scanning circuit for supplying a data signal to each memory cell column in said memory array, a buffer located on a transfer path between said memory array and said pixel array, and a latch circuit provided in said horizontal scanning circuit;

a time period for said photosensitive drum to move over one pixel row in said pixel array is considered as a main scanning period during which printing data from outside is input to said horizontal scanning circuit said printing data is held in said latch circuit in response to a latch signal input from the outside, during the input of the printing data input from the outside to said horizontal scanning circuit, one of light emission and no emission is performed sequentially in said light-emitting elements in said pixel array by reading printing data from said memory array and writing the printing data to said pixel array, and printing data for one row held in said horizontal scanning circuit is written to said memory cell.

17. The method according to claim 16, wherein said pixel array is divided into a plurality of groups of sub-pixels in said row direction and said column direction, each of said plurality of groups comprising a plurality of sub-pixels, and multi-level gradation representation is achieved by varying a number of sub-pixels emitting light among said plurality of groups.

18. The method according to claim 14, wherein said pixel array is divided into a plurality of groups of sub-pixels in said row direction and said column direction, each of said plurality of groups comprising a plurality of sub-pixels, and multi-level gradation representation is achieved by varying a number of sub-pixels emitting light among said plurality of groups.

19. A method of driving an optical printer head comprising a pixel array including pixels arranged two-dimensionally in a row direction and a column direction, each of said pixels including a light-emitting element, for selectively irradiating a surface of a rotatable photosensitive member with light in accordance with printing data, said method comprising:

in a state where pixel rows in said pixel array are in parallel to a rotational axis of said photosensitive member and said light-emitting element emits light in a direction opposed to a surface of said photosensitive member, establishing a state where a spot on the surface of said photosensitive member is irradiated with light or a state where the spot is not irradiated with light by one of light emmission and no emission from an n-th pixel, where n is an integer equal to or greater than 1, in said pixel array; and establishing a state where said spot on the surface of said photosensitive member is irradiated with light or a state where said spot is not irradiated with light by one of light emission from an (n+1)-th pixel is said pixel array during a period in which said spot passes said (n+1)-th pixel, wherein said one flight emission and no emission is performed sequentially in said light-emitting elements in said pixel array by reading printing data from a memory array and writing the printing data to said pixel array, said optical printer head comprises said memory array, a horizontal scanning circuit for supplying a data signal to each memory cell column in said memory array, a buffer located on a transfer path between said memory array and said pixel array, and a latch circuit provided in said horizontal scanning circuit, a time period for said photosensitive member to move over one pixel row in said pixel array is considered as a main scanning period during which printing data from the outside is input to said horizontal scanning circuit and said printing data is held in said latch circuit in response to a latch signal input in the outside, and during the input of the printing data input twin the outside to said horizontal scanning circuit, one of light emmission and no emission is performed sequentially in said light-emitting elements in said pixel array by reading printing data from said memory array and writing the printing data to said pixel array, and printing data for one row held in said horizontal scanning circuit is written to said memory cell.

20. The method according to claim 19, wherein said photosensitive member comprises a photosensitive drum.

21. The method according to claim 19, wherein said light-emitting element comprises an organic electroluminescence element.

22. A method of driving an optical printer head comprising a pixel array including pixels arranged two-dimensionally in a row direction and a column direction, each of said pixels including a light-emitting element, for selectively irradiating a surface of a rotatable photosensitive member with light in accordance with printing data, said method comprising:

in a state where pixel rows in said pixel stray are in parallel to a rotational axis of said photosensitive member and said ight-emitting element emits light in a direction opposed to a surface of said photosensitive member, establishing a state where a spot on the surface of said photosensitive member is irradiated with light or a state where the spot is not irradiated with light by one of light emission and no emission from an n-th pixel, where n is an integer equal to or greater than 1, in said pixel array; and establishing a state where said spot on the surface of said photosensitive member is irradiated with light or a state where said spot is not irradiated with light by one of light emission from an (n+1)-th pixel in said pixel array during a period in which said spot passes said (n+1)-th pixel, wherein said one of light emission and no emission is performed sequentially in said light-emitting elements in said pixel array by reading printing data from a memory array and writing the printing data to said pixel array, and said pixel array is divided into a plurality of groups of sub-pixels in same row direction and column direction, each of said groups comprising a plurality of sub-pixels, and multi-level gradation representation is achieved by varying number of sub-pixels emitting light among said groups of sub-pixels.

* * * * *